US010356520B2

(12) United States Patent
Nakadai et al.

(10) Patent No.: US 10,356,520 B2
(45) Date of Patent: Jul. 16, 2019

(54) ACOUSTIC PROCESSING DEVICE, ACOUSTIC PROCESSING METHOD, AND PROGRAM

(71) Applicant: HONDA MOTOR CO., LTD., Tokyo (JP)

(72) Inventors: Kazuhiro Nakadai, Wako (JP); Daniel Patryk Gabriel, Yokohama (JP); Ryosuke Kojima, Kyoto (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/120,751

(22) Filed: Sep. 4, 2018

(65) Prior Publication Data

US 2019/0075393 A1 Mar. 7, 2019

(30) Foreign Application Priority Data

Sep. 7, 2017 (JP) ..... 2017-172452

(51) Int. Cl.

| | |
|---|---|
| ***H04R 3/00*** | (2006.01) |
| ***H04R 1/40*** | (2006.01) |
| ***H04R 5/04*** | (2006.01) |
| ***G10L 21/038*** | (2013.01) |
| ***H04R 5/027*** | (2006.01) |
| ***G10L 21/0272*** | (2013.01) |

(52) U.S. Cl.

CPC ..... *H04R 3/005* (2013.01); *G10L 21/0272* (2013.01); *G10L 21/038* (2013.01); *H04R 1/406* (2013.01); *H04R 5/027* (2013.01); *H04R 5/04* (2013.01); *H04R 2201/401* (2013.01)

(58) Field of Classification Search

CPC .. H04R 3/005; H04R 1/406; H04R 2201/401; H04R 5/027; H04R 5/04; G10L 21/038

See application file for complete search history.

(56) References Cited

U.S. PATENT DOCUMENTS

2008/0262834 A1* 10/2008 Obata ..... G10L 21/028 704/200
2011/0317522 A1* 12/2011 Florencio ..... G01S 3/8006 367/129
2016/0103202 A1* 4/2016 Sumiyoshi ..... G01S 5/18 367/118

(Continued)

FOREIGN PATENT DOCUMENTS

JP 5170440 1/2013

*Primary Examiner* — Regina N Holder

(74) *Attorney, Agent, or Firm* — Rankin, Hill & Clark LLP

(57) ABSTRACT

A sound source localization unit determines a localized sound source direction that is a direction to a sound source on the basis of acoustic signals of a plurality of channels acquired from M (M is an integer equal to or greater than 3) sound pickup units being at different positions, and a sound source position estimation unit determines an intersection of straight lines to an estimated sound source direction, which is a direction from the sound pickup unit to an estimated sound source position of the sound source for each set of the two sound pickup units, classifies a distribution of intersections into a plurality of clusters, and updates the estimated sound source positions so that an estimation probability that is a probability of the estimated sound source positions being classified into clusters corresponding to the sound sources becomes high.

8 Claims, 8 Drawing Sheets

(56) References Cited

U.S. PATENT DOCUMENTS

| | | | | |
|---|---|---|---|---|
| 2016/0203828 | A1* | 7/2016 | Gomez | G10L 15/20 704/226 |
| 2017/0092287 | A1* | 3/2017 | Mizumoto | G10L 25/51 |

* cited by examiner

ACOUSTIC PROCESSING DEVICE, ACOUSTIC PROCESSING METHOD, AND PROGRAM

CROSS-REFERENCE TO RELATED APPLICATION

Priority is claimed on Japanese Patent Application No. 2017-172452, filed Sep. 7, 2017, the content of which is incorporated herein by reference.

BACKGROUND OF THE INVENTION

Field of the Invention

The present invention relates to an acoustic processing device, an acoustic processing method, and a program.

Description of Related Art

It is important to acquire information on a sound environment in understanding the environment. In the related art, basic technologies such as sound source localization, sound source separation, and sound source identification have been proposed in order to detect a specific sound source from various sound sources or in noise in the sound environment. Regarding a specific sound source, for example the cries of birds or utterances of people are useful sounds for a listener who is a user. The sound source localization means estimates a direction to or a position of a sound source. The estimated direction or position of the sound source is a clue for sound source separation or sound source identification.

For sound source localization, Japanese Patent No. 5170440 (hereinafter referred to as Patent Document 1) discloses a sound source tracking system that specifies a sound source position using a plurality of microphone arrays. The sound source tracking system described in Patent Document 1 measures a position or azimuth of a sound source on the basis of an output from a first microphone array mounted on a moving body and an attitude of the first microphone array, measures a position and a speed of the sound source on the basis of an output from a second microphone array that is stationary, and integrates respective measurement results.

SUMMARY OF THE INVENTION

However, various noises or environmental sounds are mixed in sound picked up by each microphone array. Since directions to other sound sources such as noises or environmental sounds are estimated in addition to a target sound source, directions to a plurality of sound sources picked up by respective microphone arrays are not accurately integrated between the microphone arrays.

An aspect of the present invention has been made in view of the above points, and an object thereof is to provide an acoustic processing device, an acoustic processing method, and a program capable of more accurately estimating a sound source position.

In order to achieve the above object, the present invention adopts the following aspects.

(1) An acoustic processing device according to an aspect of the present invention includes a sound source localization unit configured to determine a localized sound source direction that is a direction to a sound source on the basis of acoustic signals of a plurality of channels acquired from M (M is an integer equal to or greater than 3) sound pickup units being at different positions; and a sound source position estimation unit configured to determine an intersection of straight lines to an estimated sound source direction, which is a direction from the sound pickup unit to an estimated sound source position of the sound source for each set of the two sound pickup units, classify a distribution of intersections into a plurality of clusters, and update the estimated sound source positions so that an estimation probability that is a probability of the estimated sound source positions being classified into clusters corresponding to the sound sources becomes high.

(2) In the aspect of (1), the estimation probability may be a product having a first probability that is a probability of the estimated sound source direction being obtained when the localized sound source direction is determined, a second probability that is a probability of the estimated sound source position being obtained when the intersection is determined, and a third probability that is a probability of appearance of the cluster into which the intersection is classified, as factors.

(3) In the aspect of (2), the first probability may follow a von-Mises distribution with reference to the localized sound source direction, the second probability may follow a multidimensional Gaussian function with reference to a position of the intersection, and the sound source position estimation unit may update a shape parameter of the von-Mises distribution and a mean and variance of the multidimensional Gaussian function so that the estimation probability becomes high.

(4) In any one of the aspects of (1) to (3), the sound source position estimation unit may determine a centroid of three intersections determined from the three sound pickup units as an initial value of the estimated sound source position.

(5) In any one of aspects (1) to (4), the acoustic processing device may further include: a sound source separation unit configured to separates acoustic signals of the plurality of channels into sound source-specific signals for respective sound sources; a frequency analysis unit configured to calculates a spectrum of the sound source-specific signal; and a sound source specifying unit configured to classifies the spectra into a plurality of second clusters, determines whether or not the sound sources related to the respective spectra classified into the second clusters are the same, and selects the estimated sound source position of the sound source determined to be the same in preference to the sound source determined not to be the same.

(6) In the aspect of (5), the sound source specifying unit may evaluate stability of a second cluster on the basis of a variance of the estimated sound source positions of the sound sources related to the spectra classified into each of the second clusters, and preferentially select the estimated sound source position of a sound source of which the spectrum is classified into the second cluster having higher stability.

(7) An acoustic processing method according to an aspect of the present invention is an acoustic processing method in an acoustic processing device, the acoustic processing method including: a sound source localization step in which the acoustic processing device determines a localized sound source direction that is a direction to a sound source on the basis of acoustic signals of a plurality of channels acquired from M (M is an integer equal to or greater than 3) sound pickup units being at different positions; and a sound source position estimation step in which the acoustic processing device determines an intersection of straight lines to an estimated sound source direction, which is a direction from the sound pickup unit to an estimated sound source position of the sound source for each set of the two sound pickup units, classifies a distribution of intersections into a plurality of clusters, and updates the estimated sound source positions so that an estimation probability that is a probability of the estimated sound source positions being classified into clusters corresponding to the sound sources becomes high.

(8) A non-transitory storage medium according to an aspect of the present invention stores a program for causing a computer to execute: a sound source localization procedure of determining a localized sound source direction that is a direction to a sound source on the basis of acoustic signals of a plurality of channels acquired from M (M is an integer equal to or greater than 3) sound pickup units being at different positions; and a sound source position estimation procedure of determining an intersection of straight lines to an estimated sound source direction, which is a direction from the sound pickup unit to an estimated sound source position of the sound source for each set of the two sound pickup units, classifies a distribution of intersections into a plurality of clusters, and updates the estimated sound source positions so that an estimation probability that is a probability of the estimated sound source positions being classified into clusters corresponding to the sound sources becomes high.

According to the aspects of (1), (7), and (8), the estimated sound source position is adjusted so that the probability of the estimated sound source position of the corresponding sound source being classified into a range of clusters into which the intersections determined by the localized sound source directions from different sound pickup units are classified becomes higher. Since the sound source is highly likely to be in the range of the clusters, the estimated sound source position to be adjusted can be obtained as a more accurate sound source position.

According to the aspect of (2), it is possible to determine the estimated sound source position using the first probability, the second probability, and the third probability as independent estimation probability factors. In general, the localized sound source direction, the estimated sound source position, and the intersection depend on each other. Therefore, according to the aspect of (2), a calculation load related to adjustment of the estimated sound source position is reduced.

According to the aspect of (3), a function of the estimated sound source direction of the first probability and a function of the estimated sound source position of the second probability are represented by a small number of parameters such as a shape parameter, a mean, and a variance. Therefore, a calculation load related to the adjustment of the estimated sound source position is further reduced.

According to the aspect of (4), it is possible to set the initial value of the estimated sound source position in a triangular region having three intersections at which the sound source is highly likely to be as vertexes. Therefore, a calculation load before change in the estimated sound source position due to adjustment converges is reduced.

According to the aspect of (5), a likelihood of the estimated sound source position estimated on the basis of the intersection of the localized sound source direction of the sound source not determined to be the same on the basis of the spectrum being rejected becomes higher. Therefore, it is possible to reduce a likelihood of the estimated sound source position being erroneously selected as a virtual image (ghost) on the basis of the intersection between estimated sound source directions to different sound sources.

According to the aspect of (6), a likelihood of the estimated sound source position of the sound source corresponding to the second cluster into which the spectrum of a normal sound source is classified being selected as the estimated sound source position becomes higher. That is, a likelihood of the estimated sound source position estimated on the basis of the intersection between the estimated sound source directions to different sound sources being accidentally included in the second cluster in which the estimated sound source position is selected becomes lower. Therefore, it is possible to further reduce the likelihood of the estimated sound source position being erroneously selected as the virtual image on the basis of the intersection between the estimated sound source directions to different sound sources.

DETAILED DESCRIPTION OF THE INVENTION

Figure 1:
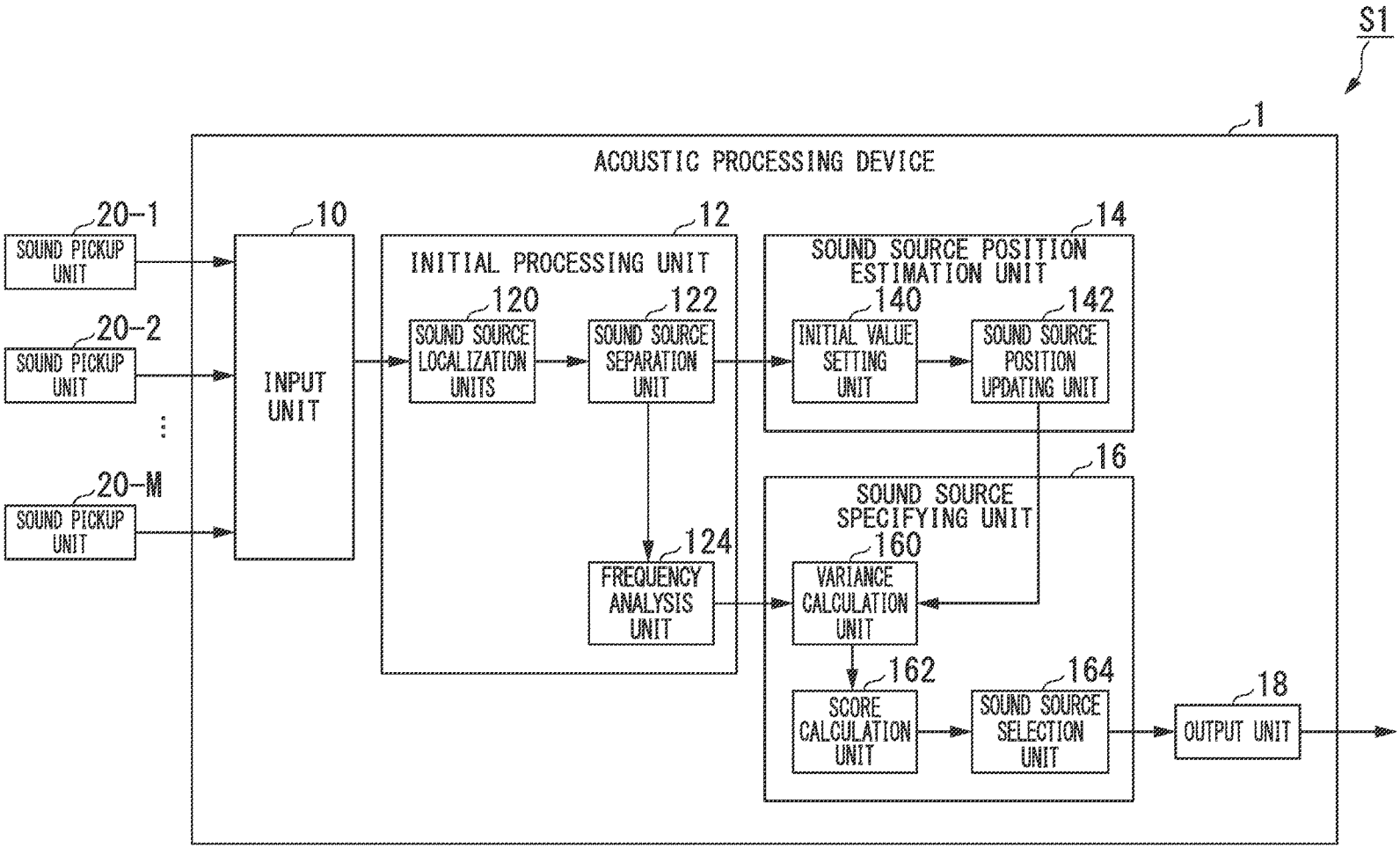
FIG. 1 is a block diagram illustrating a configuration of an acoustic processing system according to an embodiment of the present invention.

Hereinafter, embodiments of the present invention will be described with reference to the drawings. FIG. 1 is a block diagram illustrating a configuration of an acoustic processing system S1 according to this embodiment. The acoustic processing system S1 includes an acoustic processing device 1 and M sound pickup units 20. In FIG. 1, the sound pickup units 20-1, 20-2, . . . , 20-M indicate individual sound pickup units 20.

The acoustic processing device 1 performs sound source localization on acoustic signals of a plurality of channels acquired from the respective M sound pickup units 20 and estimates localized sound source directions which are sound source directions to respective sound sources. The acoustic processing device 1 determines intersections of straight lines from positions of the respective sound pickup units to the respective sound sources in the estimated sound source directions for each set of two sound pickup units 20 among the M sound pickup units 20. The estimated sound source direction means the direction of the sound source estimated from each sound pickup unit 20. An estimated position of the sound source is called an estimated sound source position. The acoustic processing device 1 performs clustering on a distribution of determined intersections and classifies the distribution into a plurality of clusters. The acoustic processing device 1 updates the estimated sound source position so that an estimation probability, which is a probability of the estimated sound source position being classified into a cluster corresponding to the sound source, becomes high. An example of a configuration of the acoustic processing device 1 will be described below.

The M sound pickup units 20 are arranged at different positions, respectively. Each of the sound pickup units 20 picks up a sound arriving at a part thereof and generates an acoustic signal of a Q (Q is an integer equal to or greater than 2) channel from the picked-up sound. Each of the sound pickup units 20 is, for example, a microphone array including Q microphones (electroacoustic transducing elements) arranged at different positions within a predetermined area. For each sound pickup unit 20, the shape of an area in which each microphone is arranged is arbitrary. The shape of the region may be a square, a circle, a spherical shape, and an ellipse. Each sound pickup unit 20 outputs the acquired acoustic signal of the Q channel to the acoustic processing device 1. Each of the sound pickup units 20 may include an input and output interface for transmitting the acoustic signal of the Q channel wirelessly or using a wire. Each of the sound pickup units 20 occupies a certain space, but unless otherwise specified, the position of the sound pickup unit 20 means a position of one point (for example, a centroid) representative of the space. It should be noted that the sound pickup unit 20 may be referred to as a microphone array m. Further, each microphone array m may be distinguished from the microphone arrays $m_k$ or the like using an index k or the like.

(Acoustic Processing Device)

Next, an example of a configuration of the acoustic processing device 1 will be described. The acoustic processing device 1 includes an input unit 10, an initial processing unit 12, a sound source position estimation unit 14, a sound source specifying unit 16, and an output unit 18. The input unit 10 outputs an acoustic signal of the Q channel input from each microphone array m to the initial processing unit 12. The input unit 10 includes, for example, an input and output interface. The microphone array m includes a separate device, such as a storage medium such as a recording device, a content editing device, or an electronic computer, and the acoustic signal of the Q channel acquired by each microphone array m may be input from each of these devices to the input unit 10. In this case, the microphone array m may be omitted in the acoustic processing system S1.

The initial processing unit 12 includes a sound source localization unit 120, a sound source separation unit 122, and a frequency analysis unit 124. The sound source localization unit 120 performs sound source localization on the basis of the acoustic signal of the Q channel acquired from each microphone array $m_k$, which is input from the input unit 10, and estimates the direction of each sound source for each frame having a predetermined length (for example, 100 ms). The sound source localization unit 120 calculates a spatial spectrum indicating the power in each direction using, for example, a multiple signal classification (MUSIC) method in the sound source localization.

The sound source localization unit 120 determines a sound source direction of each sound source on the basis of a spatial spectrum. The sound source localization unit 120 outputs sound source direction information indicating the sound source direction of each sound source determined for each microphone array m and the acoustic signal of the Q channel acquired by the microphone array m to the sound source separation unit 122 in association with each other. The MUSIC method will be described below.

The number of sound sources determined in this step may vary from frame to frame. The number of sound sources to be determined can be 0, 1 or more. It should be noted that, in the following description, the sound source direction determined through the sound source localization may be referred to as a localized sound source direction. Further, the localized sound source direction of each sound source determined on the basis of the acoustic signal acquired by the microphone array $m_k$ may be referred to as a localized sound source direction $d_{mk}$. The number of detectable sound sources that is a maximum value of the number of sound sources that the sound source localization unit 120 can detect may be simply referred to as the number of sound sources $D_m$. One sound source specified on the basis of the acoustic signal acquired from the microphone array $m_k$ among the $D_m$ sound sources may be referred to as a sound source $\delta_k$.

The sound source direction information of each microphone array m and the acoustic signal of the Q channel are input from the sound source localization unit 120 to the sound source separation unit 122. For each microphone array m, the sound source separation unit 122 separates the acoustic signal of the Q channel into sound source-specific acoustic signals indicating components of the respective sound sources on the basis of the localized sound source direction indicated by the sound source direction information. The sound source separation unit 122 uses, for example, a geometric-constrained high-order decorrelation-based source selection (GHDSS) method when performing separation into the sound source-specific acoustic signals. For each microphone array m, the sound source separation unit 122 outputs the separated sound source-specific acoustic signal of each sound source and the sound source direction information indicating the localized sound source direction of the sound source to the frequency analysis unit 124 and the sound source position estimation unit 14 in association with each other. The GHDSS method will be described below.

The sound source-specific acoustic signal of each sound source and the sound source direction information for each microphone array m are input to the frequency analysis unit 124 in association with each other. The frequency analysis unit 124 performs frequency analysis on the sound source-specific acoustic signal of each sound source separated from the acoustic signal related to each microphone array m for each frame having a predetermined time length (for example, 128 points) to calculate spectra $[F_{m,1}]$, $[F_{m,2}]$, . . . , $[F_{m,sm}]$. [ . . . ] indicates a set including a plurality of values such as a vector or a matrix. $s_m$ indicates the number of sound sources estimated through the sound source localization and the sound source separation from the acoustic signal acquired by the microphone array m. Here, each of the spectra $[F_{m,1}]$, $[F_{m,2}]$, . . . , $[F_{m,sm}]$ is a row vector. In the frequency analysis, the frequency analysis unit 124, for example, performs a short term Fourier transform (STFT) on a signal obtained by applying a 128-point Hamming window on each sound source-specific acoustic signal. The frequency analysis unit 124 causes temporally adjacent frames to overlap and sequentially shifts a frame constituting a section that is an analysis target. When the number of elements of a frame which is a unit of frequency analysis is 128, the number of elements of each spectrum is 65 points. The number of elements in a section in which adjacent frames overlap is, for example, 32 points.

The frequency analysis unit 124 integrates the spectra of each sound source between rows to form a spectrum matrix $[F_m]$ (m is an integer between 1 and M) for each microphone array m shown in Equation (1). The frequency analysis unit 124 further integrates the formed spectrum matrices $[F_1]$, $[F_2]$, . . . , $[F_M]$ between rows to form a spectrum matrix [F] shown in Equation (2). The frequency analysis unit 124 outputs the formed spectrum matrix [F] and the sound source direction information indicating the localized sound source direction of each sound source to the sound source specifying unit 16 in association with each other.

$$[F_m]=[[F_{m,1}],[F_{m,2}], \ldots ,[F_{m,s_m}]]^T \quad (1)$$

$$[F]=[[F_1],[F_2], \ldots ,[F_M]]^T \quad (2)$$

The sound source position estimation unit 14 includes an initial value setting unit 140 and a sound source position updating unit 142. The initial value setting unit 140 determines an initial value of the estimated sound source position which is a position estimated as a candidate for the sound source using triangulation on the basis of the sound source direction information for each microphone array m input from the sound source separation unit 122. Triangulation is a scheme for determining a centroid of three intersections related to a certain candidate for the sound source determined from a set of three microphone arrays among M microphone arrays, as an initial value of the estimated sound source position of the sound source. In the following description, the candidate for the sound source is called a sound source candidate. The intersection is a point at which the straight lines in the localized sound source direction estimated on the basis of the acoustic signal acquired by the microphone array m, which pass through the position of each microphone array m for each set of two microphone arrays m among the three microphone arrays m intersect. The initial value setting unit 140 outputs the initial estimated sound source position information indicating the initial value of the estimated sound source position of each sound source candidate to the sound source position updating unit 142. An example of the initial value setting process will be described below.

The sound source position updating unit 142 determines an intersection of the straight line from each microphone array m to the estimated sound source direction of the sound source candidate related to the localized sound source direction based on the microphone array m for each of the sets of the microphone arrays m. The estimated sound source direction means a direction to the estimated sound source position. The sound source position updating unit 142 performs clustering on the spatial distribution of the determined intersections and classifies the spatial distribution into a plurality of clusters (groups). The sound source position updating unit 142 updates the estimated sound source position so that the estimation probability that is a probability of the estimated sound source position for each sound source candidate being classified into a cluster corresponding to each sound source candidate becomes higher.

The sound source position updating unit 142 uses the initial value of the estimated sound source position indicated by the initial estimated sound source position information input from the initial value setting unit 140 as the initial value of the estimated sound source position for each sound source candidate. When the amount of updating of the estimated sound source position or the estimated sound source direction becomes smaller than the threshold value of a predetermined amount of updating, the sound source position updating unit 142 determines that change in the estimated sound source position or the estimated sound source direction has converged, and stops updating of the estimated sound source position. The sound source position updating unit 142 outputs the estimated sound source position information indicating the estimated sound source position for each sound source candidate to the sound source specifying unit 16. When the amount of updating is equal to or larger than the predetermined threshold value of the amount of updating, the sound source position updating unit 142 continues a process of updating the estimated sound source position for each sound source candidate. An example of the process of updating the estimated sound source position will be described below.

The sound source specifying unit 16 includes a variance calculation unit 160, a score calculation unit 162, and a sound source selection unit 164. The spectral matrix [F] and the sound source direction information are input from the frequency analysis unit 124 to the variance calculation unit 160, and the estimated sound source position information is input from the sound source position estimation unit 14. The variance calculation unit 160 repeats a process to be described next a predetermined number of times. The repetition number R is set in the variance calculation unit 160 in advance.

The variance calculation unit 160 performs clustering on a spectrum of each sound source for each sound pickup unit 20 indicated by the spectrum matrix [F], and classifies the spectrum into a plurality of clusters (groups). The clustering executed by the variance calculation unit 160 is independent of the clustering executed by the sound source position updating unit 142. The variance calculation unit 160 uses, for example, a k-means clustering as a clustering scheme. In the k-means method, each of a plurality of pieces of data that is a clustering target is randomly assigned to k clusters. The variance calculation unit 160 changes the assigned cluster as an initial value for each spectrum at each repetition number r. In the following description, the cluster classified by the variance calculation unit 160 is referred to as a second cluster. The variance calculation unit 160 calculates an index value indicating a degree of similarity of the plurality of spectra belonging to each of the second clusters. The variance calculation unit 160 determines whether or not the sound source candidates related to the respective spectra are the same according to whether or not the calculated index value is higher than an index value indicating a predetermined degree of similarity.

For the sound source candidate corresponding to the second cluster determined to have the same sound source candidates, the variance calculation unit 160 calculates the variance of the estimated sound source positions of the sound sources candidate indicated by the estimated sound source position information. This is because in this step, the number of sound source candidates of which the sound source positions are updated by the sound source position updating unit 142 is likely to be larger than the number of second clusters, as will be described below. For example, when the variance calculated for the current repetition number r for the second cluster is larger than the variance calculated at the previous repetition numberr−1, the variance calculation unit 160 sets the score to 0. The variance calculation unit 160 sets the score to ε when the variance calculated for the current repetition number r for the second cluster is equal to or smaller than the variance calculated at the previous repetition number r−1. ε is, for example, a predetermined positive real number. As a frequency in an increase in the variance increases, the estimated sound source position classified into the second cluster differs according to the repetition number, that is, stability of the second cluster becomes lower. In other words, the set score indicates the stability of the second cluster. In the sound source selection unit 164, the estimated sound source position of the corresponding sound source candidate is preferentially selected when the second cluster has a higher score.

On the other hand, for the second cluster determined to have sound source candidates that are not the same, the variance calculation unit 160 determines that there is no corresponding sound source candidate, determines that the variance of the estimated sound source positions is not valid, and sets the score to δ. δ is, for example, a negative real number smaller than 0. Accordingly, in the sound source selection unit 164, the estimated sound source positions related to the sound source candidates determined to have the same sound source candidates are selected in preference to the sound source candidates that are not determined to be the same.

The variance calculation unit 160 outputs score calculation information indicating the score of each repetition number for each second cluster and the estimated sound source position to the score calculation unit 162.

The score calculation unit 162 calculates a final score for each sound source candidate corresponding to the second cluster on the basis of the score calculation information input from the variance calculation unit 160. Here, the score calculation unit 162 counts a validity, which is the number of times an effective variance is determined for each second cluster, and calculates a sum of the scores of each time. The sum of the scores increases as the number of times of validity, which is the number of times the variance increases each time, increases. That is, when stability of the second cluster is higher, a sum of scores is greater. It should be noted that in this step, one estimated sound source position may span a plurality of second clusters. Therefore, the score calculation unit 162 calculates the final score of the sound source candidate corresponding to the estimated sound source position by dividing a total sum of the scores of respective estimated sound source positions by a sum of the counted effective times. The score calculation unit 162 outputs final score information indicating the final score of the calculated sound source candidate and the estimated sound source position to the sound source selection unit 164.

The sound source selection unit 164 selects a sound source candidate in which the final score of the sound source candidate indicated by the final score information input from the score calculation unit 162 is equal to or greater than a predetermined threshold value $\theta_2$ of the final score, as a sound source. The sound source selection unit 164 rejects sound source candidates of which the final score is smaller than the threshold value $\theta_2$. The sound source selection unit 164 outputs output sound source position information indicating the estimated sound source position for each sound source to the output unit 18, for the selected sound source.

The output unit 18 outputs the output sound source position information input from the sound source selection unit 164 to the outside of the acoustic processing device 1. The output unit 18 includes, for example, an input and output interface. The output unit 18 and the input unit 10 may be configured by common hardware. The output unit 18 may include a display unit (for example, a display) that displays the output sound source position information. The acoustic processing device 1 may be configured to include a storage medium that stores the output sound source position information together with or in place of the output unit 18.

(Music Method)

Next, a MUSIC method which is one sound source localization scheme will be described.

The MUSIC method is a scheme of determining a direction ϕ in which a power $P_{ext}(\phi)$ of the spatial spectrum to be described below is maximal and higher than a predetermined level as the localized sound source direction. In the storage unit included in the sound source localization unit 120, a transfer function for each direction ϕ distributed at predetermined intervals (for example, 5°) is stored in advance. In the embodiment, processes to be executed next are executed for each microphone array m.

The sound source localization unit 120 generates a transfer function vector [D(ϕ)] having a transfer function $D_{[q]}(\omega)$ from the sound source to each microphone corresponding to each channel q (q is an integer equal to or greater than 1 and equal to or smaller than Q) as an element, for each direction ϕ.

The sound source localization unit 120 calculates a conversion coefficient ζ q(ω) by converting the acoustic signal $\zeta_q$ of each channel q into a frequency domain for each frame having a predetermined number of elements. The sound source localization unit 120 calculates an input correlation matrix $[R_{\zeta\zeta}]$ shown in Equation (3) from the input vector [ζ(ω)] including the calculated conversion coefficient as an element.

$$[R_{\zeta\zeta}]=E[[\zeta(\omega)][\zeta(\omega)]^*] \tag{3}$$

In Equation (3), E[ . . . ] indicates an expected value of . . . . [ . . . ] indicates that . . . is a matrix or vector. [ . . . ]* indicates a conjugate transpose of a matrix or vector. The sound source localization unit 120 calculates an eigenvalue $\delta_p$ and an eigenvector $[\varepsilon_p]$ of the input correlation matrix $[R_{\zeta\zeta}]$. The input correlation matrix $[R_{\zeta\zeta}]$, the eigenvalue $\delta_p$, and the eigenvector $\zeta_p$ have a relationship shown in Equation (4).

$$[R_{\zeta\zeta}][\varepsilon_p]=\delta_p[\varepsilon_p] \tag{4}$$

In Equation (4), p is an integer equal to or greater than 1 and equal to or smaller than Q. An order of the index p is a descending order of the eigenvalues $\delta_p$. The sound source localization unit 120 calculates a power $P_{sp}(\phi)$ of a frequency-specific spatial spectrum shown in Equation (5) on the basis of the transfer function vector [D(ϕ)] and the calculated eigenvector $[\varepsilon_p]$.

$$P_{sp}(\psi) = \frac{|[D(\psi)]^*[D(\psi)]|}{\sum_{p=D_m+1}^{Q} |[D(\psi)]^*[\varepsilon_p]|} \tag{5}$$

In Equation (5), $D_m$ is a maximum number (for example, 2) of sound sources that can be detected, which is a predetermined natural number smaller than Q. The sound source localization unit 120 calculates a sum of the spatial spectra $P_{sp}(\phi)$ in a frequency band in which an S/N ratio is larger than a predetermined threshold value (for example, 20 dB) as a power $P_{ext}$ (ϕ) of the spatial spectrum in an entire band.

It should be noted that the sound source localization unit 120 may calculate the localized sound source direction using other schemes instead of the MUSIC method. For example, a weighted delay and sum beam forming (WDS-BF) method can be used. The WDS-BF method is a scheme of calculating a square value of a delay and sum of the acoustic signal $\zeta_q(t)$ in the entire band of each channel q as a power $P_{ext}(\phi)$ of the spatial spectrum, as shown in Equation (6), and searching for a localized sound source direction it, in which the power $P_{ext}(\phi)$ of the spatial spectrum is maximized.

$$P_{ext}(\psi)=[D(\psi)]^*E[[\zeta(t)][\zeta(t)]^*][D(\psi)] \tag{6}$$

A transfer function indicated by each element of $[D(\phi)]$ in Equation (6) indicates a contribution due to a phase delay from the sound source to the microphone corresponding to each channel q (q is an integer equal to or greater than 1 and equal to or smaller than Q).

$[\zeta(t)]$ is a vector having a signal value of the acoustic signal $\zeta_q(t)$ of each channel q at a time t as an element.

(GHDSS Method)

Next, a GHDSS method which is one sound source separation scheme will be described.

The GHDSS method is a method of adaptively calculating a separation matrix $[V(\omega)]$ so that a separation sharpness $J_{SS}([V(\omega)])$ and a geometric constraint $J_{GC}([V(\omega)])$ as two cost functions decrease. In the present embodiment, a sound source-specific acoustic signal is separated from each acoustic signal acquired by each microphone array m.

The separation matrix $[V(\omega)]$ is a matrix that is used to calculate a sound source-specific acoustic signal (estimated value vector) $[u'(\omega)]$ of each of the maximum $D_m$ number of detected sound sources by multiplying the separation matrix $[V(\omega)]$ by the acoustic signal $[\zeta(\omega)]$ of the Q channel input from the sound source localization unit 120. Here, $[\ldots]^T$ indicates a transpose of a matrix or a vector.

The separation sharpness $J_{SS}([V(\omega)])$ and the geometric constraint $J_{GC}([V(\omega)])$ are expressed by Equations (7) and (8), respectively.

$$J_{SS}([V(\omega)])=\|\phi([u'(\omega)])[u'(\omega)]^*-\mathrm{diag}[\phi([u'(\omega)])[u'(\omega)]^*]\|^2 \tag{7}$$

$$J_{GC}([V(\omega)])=\|\mathrm{diag}[[V(\omega)][D(\omega)]-[I]]\|^2 \tag{8}$$

In Equations (7) and (8), $\|\ldots\|^2$ is a Frobenius norm of the matrix . . . . The Frobenius norm is a sum of squares (scalar values) of respective element values constituting a matrix. $\phi([u'(\omega)])$ is a nonlinear function of the sound source-specific acoustic signal $[u'(\omega)]$, such as a hyperbolic tangent function. diag[ . . . ] indicates a sum of the diagonal elements of the matrix . . . . Therefore, the separation sharpness $J_{SS}([V(\omega)])$ is an index value indicating a magnitude of an inter-channel non-diagonal component of the spectrum of the sound source-specific acoustic signal (estimated value), that is, a degree of a certain sound source being erroneously separated with respect to another sound source. Also, in Equation (8), [I] indicates a unit matrix. Therefore, the geometric constraint $J_{GC}([V(\omega)])$ is an index value indicating a degree of an error between the spectrum of the sound source-specific acoustic signal (estimated value) and the spectrum of the sound source-specific acoustic signal (sound source).

(Setting of Initial Value)

Figure 2:
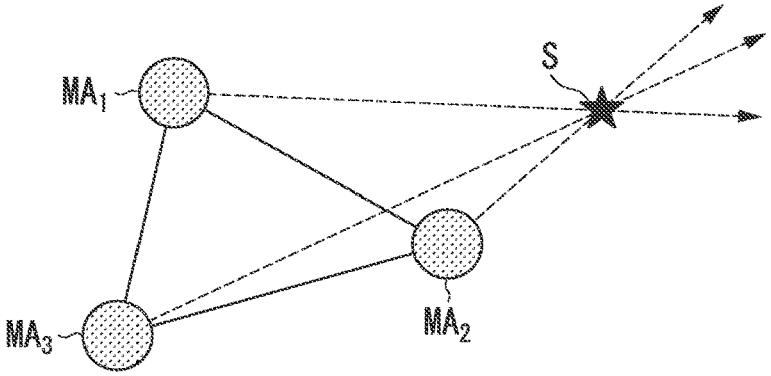
FIG. 2 is a diagram illustrating an example of a sound source direction estimated to be an arrangement of a microphone array.

Next, an example of a setting of the initial value will be described. The intersection determined on the basis of the two microphone arrays m should ideally be the same as the sound source position of each sound source. FIG. 2 illustrates a case in which the localized sound source direction of the sound source S is estimated on the basis of the acoustic signals acquired by the microphone arrays $MA_1$, $MA_2$, and $MA_3$ installed at different positions. In this example, straight lines directed to the localized sound source direction estimated on the basis of the acoustic signal acquired by each microphone array, which pass through the positions of the microphone arrays $MA_1$, $MA_2$, and $MA_3$, are determined. The three straight lines intersect at one point at the position of the sound source S.

Figure 3:
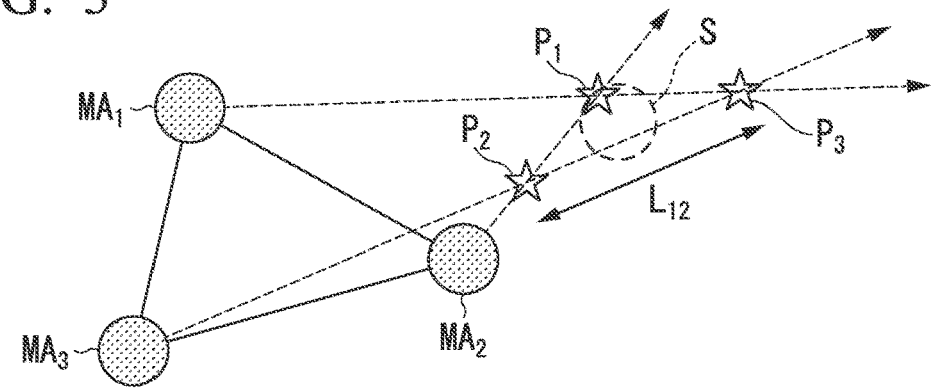
FIG. 3 is a diagram illustrating an example of intersections based on a set of sound source directions that are estimated from respective microphone arrays.

However, an error is included in the localized sound source direction of the sound source S. In reality, the positions of the intersections $P_1$, $P_2$, and $P_3$ related to one sound source are different from each other, as illustrated in FIG. 3. The intersection $P_1$ is an intersection of straight lines in the localized sound source direction of the sound source S estimated from the acoustic signals acquired by the respective microphone arrays $MA_1$ and $MA_2$, which pass through the positions of the microphone arrays $MA_1$ and $MA_2$. The intersection $P_2$ is an intersection of straight lines in the localized sound source direction of the sound source S estimated from the acoustic signals acquired by the respective microphone arrays $MA_2$ and $MA_3$, which pass through the positions of the microphone arrays $MA_2$ and $MA_3$. The intersection $P_3$ is an intersection of straight lines in the localized sound source direction of the sound source S estimated from the acoustic signals acquired by the respective microphone arrays $MA_1$ and $MA_3$, which pass through the positions of the microphone arrays $MA_1$ and $MA_3$. When an error in the localized sound source direction estimated from the acoustic signals acquired by the respective microphone arrays for the same sound source S is random, a true sound source position is expected to be in an internal region of a triangle having the intersections $P_1$, $P_2$, and $P_3$ as vertexes. Therefore, the initial value setting unit 140 determines a centroid between the intersections $P_1$, $P_2$, and $P_3$ to be an initial value $x_n$ of the estimated sound source position of the sound source candidate that is a candidate for the sound source S.

However, the number of sound source directions estimated from the acoustic signals that the sound source localization unit 120 has acquired from the microphone array m is not limited to one, and may be more than one. Therefore, the intersections $P_1$, $P_2$, and $P_3$ are not always determined on the basis of the direction of the same sound source S. Therefore, the initial value setting unit 140 determines whether the distances $L_{12}$, $L_{23}$, and $L_{13}$ between the two intersections among the three intersections $P_1$, $P_2$, and $P_3$ are both smaller than the predetermined distance threshold value $\theta_1$ and whether or not there is a distance such that at least one of the distances between intersections is equal to or greater than the threshold value $\theta_1$. When the initial value setting unit 140 determines that any of the distances is smaller than the threshold value $\theta_1$, the initial value setting unit 140 adopts the centroid of the intersections $P_1$, $P_2$, and $P_3$ as the initial value $x_n$ of the sound source position of the sound source candidate n. When at least any one of the distances between the intersections is equal to or larger than the threshold value $\theta_1$, the initial value setting unit 140 rejects the centroid of the intersections $P_1$, $P_2$, and $P_3$ without determining the centroid as an initial value $x_n$ of the sound source position.

Here, positions $u_{MA1}$, $u_{MA2}$, . . . , $u_{MAM}$ of the M microphone arrays $MA_1$, $MA_2$, . . . , $MA_M$ are set in the sound source position estimation unit 14 in advance. A position vector [u] having the positions $u_{MA1}$, $u_{MA2}$, . . . , $u_{MAM}$ of the individual M microphone arrays $MA_1$, $MA_2$, . . . , $MA_M$ as elements is expressed by Equation (9).

$$[u]=[u_{MA_1}, u_{MA_2}, \ldots, u_{MA_M}]^T \tag{9}$$

In Equation (9), a position $u_{MAm}$ (m is an integer between 1 and M) of the microphone array m is two-dimensional coordinates [$u_{MAxm}$, $u_{MAy}$] having an x coordinate $u_{MAxm}$ and a y coordinate $u_{MAym}$ as element values.

As described above, the sound source localization unit 120 determines a maximum $D_m$ number of localized sound source directions d'm(1), d'm(2), . . . , d'm($D_m$) from the acoustic signals of the Q channel acquired by each microphone array $MA_m$, for each frame. A vector [d'] having the localized sound source directions d'm(1), d'm(2), . . . d'm ($D_m$) as elements is expressed by Equation (10).

$$[d'_m]=[h'_m(1),d'_m(2), \ldots ,d'_m(D_m)]^T \tag{10}$$

Figure 4:
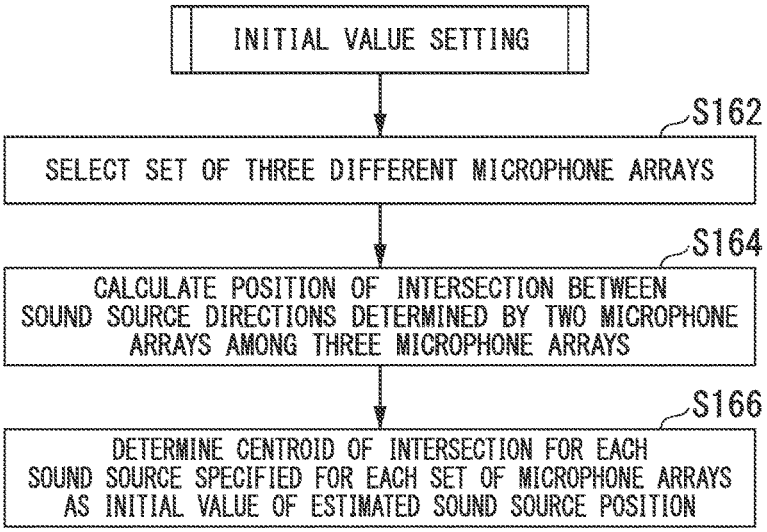
FIG. 4 is a flowchart showing an example of an initial value setting process according to the embodiment.

Next, an example of the initial value setting process according to the present embodiment will be described. FIG. 4 is a flowchart showing an example of the initial value setting process according to the present embodiment.

(Step S162) The initial value setting unit 140 selects a triplet of three different microphone arrays $m_1$, $m_2$, and $m_3$ from the M microphone arrays in triangulation. Thereafter, the process proceeds to step S164.

(Step S164) The initial value setting unit 140 selects localized sound source directions $d'_{m1}(\delta_1)$, $d'_{m2}(\delta_2)$, and $d'_{m3}(\delta_3)$ of sound sources $\delta_1$, $\delta_2$, and $\delta_3$ from the maximum $D_m$ number of sound sources estimated on the basis of the acoustic signals acquired by the respective microphone arrays for the three selected microphone arrays $m_1$, $m_2$, and $m_3$ in the set. A direction vector [d"] having the three selected localized sound source directions $d'_{m1}(\delta 1)$, $d'_{m2}(\delta 2)$, and $d'_{m3}(\delta 3)$ as elements is expressed by Equation (11). It should be noted that each of $\delta_1$, $\delta_2$, and $\delta_3$ is an integer between 1 and $D_m$.

$$[d'']=[d'_{m_1}(\delta_1),d'_{m_2}(\delta_2),d'_{m_3}(\delta_3)]^T, m_1 \neq m_2 \neq m_3 \tag{11}$$

The initial value setting unit 140 calculates coordinates of the intersections $P_1$, $P_2$, and $P_3$ of the straight lines of the localized sound source directions estimated from the acoustic signals acquired by the respective microphone arrays, which pass through the respective microphone arrays, for a set (pair) of two microphone arrays among the three microphone arrays. It should be noted that, in the following description, the intersection of the straight lines in the localized sound source direction estimated from the acoustic signal acquired by each microphone array, which pass through the two sets of microphone arrays, is referred to as an "intersection between the microphone array and the localized sound source direction". As shown in Equation (12), the intersection $P_1$ is determined by the positions of the microphone arrays $m_1$ and $m_2$ and the localized sound source directions $d'_{m1}(\delta_1)$ and $d'_{m2}(\delta_2)$. The intersection $P_2$ is determined by the positions of the microphone arrays $m_2$ and $m_3$ and the localized sound source directions $d'_{m2}(\delta_2)$ and $d'_{m3}(\delta_3)$. The intersection $P_3$ is determined by the positions of the microphone arrays $m_1$ and $m_3$ and the localized sound source directions $d'_{m1}(\delta_1)$ and $d'_{m3}(\delta_3)$. Thereafter, the process proceeds to step S166.

$$P_1=p(m_1(\delta_1),m_2(\delta_2))$$

$$P_2=p(m_2(\delta_2),m_3(\delta_3))$$

$$P_3=p(m_1(\delta_1),m_3(\delta_3)) \tag{12}$$

(Step S166) The initial value setting unit 140 calculates the distances $L_{12}$ between the intersections P1 and P2 which are different from each other, the distance $L_{23}$ between the intersections P2 and P3, and the distance $L_{13}$ between the intersections P1 and P3. When the calculated distances $L_{12}$, $L_{23}$, and $L_{13}$ are all equal to or smaller than the threshold value $\theta_1$, the initial value setting unit 140 selects a combination of the three intersections as a combination related to the sound source candidate n. In this case, the initial value setting unit 140 determines a centroid of the intersections P1, P2, and P3 as an initial value $x_n$ of a sound source estimation position of the sound source candidate n, as shown in Equation (13).

On the other hand, when at least one of the distances L12, L23, and L13 is larger than the threshold value $\theta_1$, the initial value setting unit 140 rejects the combination of these intersections and does not determine the initial value $x_n$. In Equation (13), $\phi$ indicates an empty set. Thereafter, the process illustrated in FIG. 4 ends.

$$x_n = \begin{cases} \frac{1}{3}\sum_{i=1}^{3} P_i, & (L_{12}, L_{23}, L_{31} \leq \theta_1) \\ \phi, & \text{(in other cases)} \end{cases} \tag{13}$$

The initial value setting unit 140 executes the processes of steps S162 to S166 for each of the combinations $d'_{m1}(\delta 1)$, $d'_{m2}(\delta 2)$, and $d'_{m3}(\delta 3)$ of the localized sound source directions estimated for the respective microphone arrays m1, m2, and m3. Accordingly, a combination of inappropriate intersections is rejected as a sound source candidate, and an initial value $x_n$ of the sound source estimation position is determined for each sound source candidate n. It should be noted that in the following description, the number of sound source candidates is represented by N.

Further, the initial value setting unit 140 may execute the processes of steps S162 to S166 for each set of three microphone arrays among the M microphone arrays. Accordingly, it is possible to prevent the omission of detection of the candidates n of the sound source.

Figure 5:
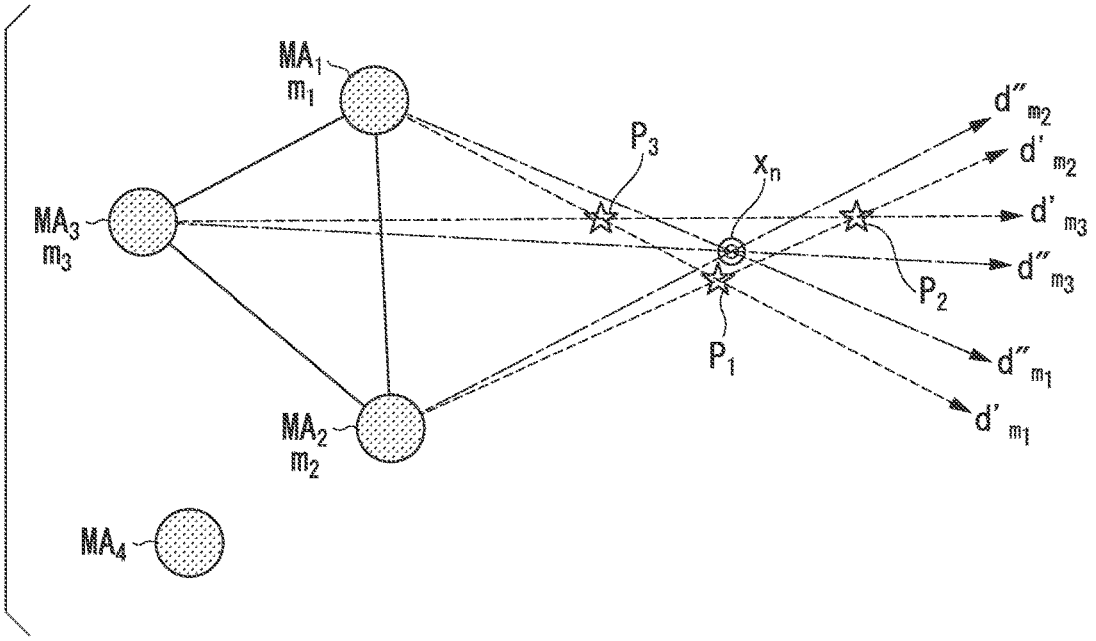
FIG. 5 is a diagram illustrating an example of an initial value of an estimated sound source position that is determined from an intersection based on a set of sound source directions.

FIG. 5 illustrates a case in which three microphone arrays $MA_1$ to $MA_3$ among four microphone arrays $MA_1$ to $MA_4$ are selected as the microphone arrays $m_1$ to $m_3$ and an initial value $x_n$ of the estimated sound source position is determined from a combination of the estimated localized sound source directions $d'_{m1}$, $d'_{m2}$, and $d'_{m3}$. A direction of the intersection $P_1$ is the same direction as the localized sound source directions $d'_{m1}$ and $d'_{m2}$ with reference to the positions of the microphone arrays $m_1$ and $m_2$. A direction of the intersection $P_2$ is the same direction as the sound source directions $d'_{m2}$ and $d'_{m3}$ with reference to the positions of the microphone arrays $m_2$ and $m_3$. A direction of the intersection $P_3$ is the same direction as the localized sound source directions $d'_{m2}$ and $d'_{m3}$ with reference to the positions of the microphone arrays $m_1$ and $m_3$. A direction of the determined initial value $x_n$ is directions $d''_{m1}$, $d''_{m2}$, and $d''_{m3}$ with reference to the positions of the microphone arrays $m_1$, $m_2$, and $m_3$. Therefore, the localized sound source directions $d'_{m1}$, $d'_{m2}$, and $d'_{m3}$ estimated through the sound source localization are corrected to the estimated sound source directions $d''_{m1}$, $d''_{m2}$, and $d''_{m3}$.

(Process of Updating Estimated Sound Source Position)

Next, a process of updating the estimated sound source position will be described. Since the sound source direction estimated through the sound source localization includes an error, the estimated sound source position for each candidate sound source estimated from the intersection between the sound source directions also includes an error. When these errors are random, it is expected that the estimated sound source positions and the intersections will be distributed around the true sound source position of each sound source.

Therefore, the sound source position updating unit 142 according to the present embodiment performs clustering on intersections between the two microphone arrays and the estimated sound source direction, and classifies a distribution of these intersections into a plurality of clusters. Here, the estimated sound source direction means a direction of the estimated sound source position. As a clustering scheme, the sound source position updating unit 142 uses, for example, a k-means method. The sound source position updating unit 142 updates the estimated sound source position so that an estimation probability, which is a degree of likelihood of the estimated sound source position for each sound source candidate being classified into clusters corresponding to the respective sound source candidates, becomes high.

(Probabilistic Model)

When the sound source position updating unit 142 calculates the estimated sound source position, the sound source position updating unit 142 uses a probabilistic model based on triangulation. In this probabilistic model, it can be assumed that the estimation probability of the estimated sound source positions for respective sound source candidates being classified into the clusters corresponding to the respective sound source candidates approximates to factorization by being represented by a product having a first probability, a second probability, and a third probability as factors. The first probability is a probability of the estimated sound source direction, which is a direction of the estimated sound source position of the sound source candidate corresponding to the sound source, being obtained when the localized sound source direction is determined through the sound source localization. The second probability is a probability of the estimated sound source position being obtained when an intersection of straight lines from the position of each of the two microphone arrays to the estimated sound source direction is determined. The third probability is a probability of an appearance of the intersection in a cluster classification.

Figure 6:
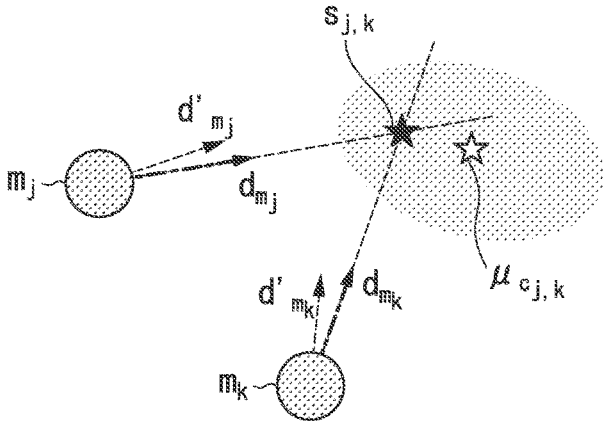
FIG. 6 is a conceptual diagram of a probabilistic model according to the embodiment.

More specifically, the first probability is assumed to follow the von-Mises distribution with reference to the localized sound source directions $d'_{mj}$ and $d'_{mk}$. That is, the first probability is based on assumption that an error in which the probability distribution is the von-Mises distribution is included in the localized sound source directions $d'_{mj}$ and $d'_{mk}$ estimated from the acoustic signals acquired by the microphone arrays $m_j$ and $m_k$ through the sound source localization. Ideally, in the example illustrated in FIG. 6, when there is no error, true sound source directions $d_{mj}$ and $d_{mk}$ are obtained as the localized sound source directions $d'_{mj}$ and $d'_{mk}$.

The second probability is assumed to follow a multidimensional Gaussian function with reference to the position of the intersection $s_{j,k}$ between the microphone arrays $m_j$ and $m_k$ and the estimated sound source directions $d_{mj}$ and $d_{mk}$. That is, the second probability is based on the assumption that Gaussian noise is included, as an error for which the probability distribution is a multidimensional Gaussian distribution, in the estimated sound source position which is the intersection $s_{j,k}$ of the straight lines, which pass through each of the microphone arrays $m_j$ and $m_k$ and respective directions thereof become the estimated sound source directions $d_{mj}$ and $d_{mk}$. Ideally, the coordinates of the intersection $s_{j,k}$ are a mean value $\mu_{cj,k}$ of the multidimensional Gaussian function.

Accordingly, the sound source position updating unit 142 estimates the estimated sound source directions $d_{mj}$ and $d_{mk}$ so that the coordinates of the intersection $s_{j,k}$ giving the estimated sound source direction of the sound source candidate is as close as possible to a mean value $\mu_{cj,k}$ of the multidimensional Gaussian function approximating the distribution of the intersections $s_{j,k}$ on the basis of the localized sound source direction $d'_{mj}$ and $d'_{mk}$ obtained through the sound source localization.

The third probability indicates an appearance probability of the cluster $c_{j,k}$ into which the intersection $s_{j,k}$ of the straight lines which pass through the microphone arrays $m_j$ and $m_k$ and respective directions thereof become the estimated sound source directions $d_{mj}$ and $d_{mk}$ is classified. That is, the third probability indicates an appearance probability in the cluster $C_{j,k}$ of the estimated sound source position corresponding to the intersection $s_{j,k}$.

In order to associate each cluster with the sound source, the sound source position updating unit 142 performs initial clustering on the initial value of the estimated sound source position $x_n$ for each sound source candidate to determine the number C of clusters.

In initial clustering, the sound source position updating unit 142 performs hierarchical clustering on the estimated sound source position $x_n$ of each sound source candidate using a predetermined Euclidean distance threshold value $\phi$, as a parameter, as shown in Equation (14), to classify the estimated sound source positions into a plurality of clusters. The hierarchical clustering is a scheme of generating a plurality of clusters including only one piece of target data as an initial state, calculating a Euclidean distance between two clusters including different pieces of corresponding data, and sequentially merging clusters having the smallest calculated Euclidean distance to form a new cluster. A process of merging the clusters is repeated until the Euclidean distance reaches the threshold value $\phi$. As the threshold value $\phi$, for example, a value larger than the estimation error of the sound source position may be set in advance. Therefore, a plurality of sound source candidates of which the distance is smaller than the threshold value $\pi$, are aggregated into one cluster, and each cluster is associated with a sound source. The number C of clusters obtained by clustering is estimated as the number of sound sources.

$$c_n = \text{hierarchy}(x_n, \phi) \tag{14}$$

$$C = \max(c_n)$$

In Equation (14), hierarchy indicates hierarchical clustering. $c_n$ indicates an index $c_n$ of each cluster obtained in clustering. max ( . . . ) indicates a maximum value of . . . .

Next, an example of an application of the probabilistic model will be described. As described above, for each microphone array mi, the first probability ($d'_{mi}$, $d_{mi}$; $\beta_{mi}$) of the estimated sound source direction $d_{mi}$ being obtained when the localized sound source direction $d'_{mi}$ is determined is assumed to follow a Von Mises distribution shown in Equation (15).

$$f(d'_{m_i}, d_{m_i}; \beta_{m_i}) = \frac{\exp(\beta_i (d'_{m_i} \cdot d_{m_i}))}{2\pi I_0(\beta_{m_i})} \tag{15}$$

The von-Mises distribution is a continuous function that sets a maximum value and a minimum value to 1 and 0, respectively. When the localized sound source direction $d'_{mi}$ and the estimated sound source direction $d_{mi}$ are the same, the von-Mises distribution has the maximum value of 1 and has a smaller function value as an angle between the localized sound source direction $d'_{mi}$ and the estimated sound source direction $d_{mi}$ increases. In Equation (15), each of the sound source direction $d'_{mi}$ and the estimated sound source direction $d_{mi}$ is represented by a unit vector having a magnitude normalized to 1. $\beta_{mi}$ indicates a shape parameter indicating the spread of the function value. As the shape parameter $\beta_{mi}$ increases, the first probability approximates a normal distribution, and as the shape parameter $\beta_{mi}$ decreases, the second probability approximates a uniform distribution. $I_0(\beta_{mi})$ indicates a zeroth order first-kind modified Bessel function. The von-Mises distribution is suitable for modeling of the distribution of noise added to the angle like the sound source direction. In the probabilistic model, the shape parameter $\beta_{mi}$ is one of model parameters.

A probability p([d']|[d]) of the estimated sound source direction [d] being obtained in the localized sound source direction [d'] in the entire acoustic processing system S1 is assumed to be a total power of the first probability $f(d'_{mi}, d_{mi}; \beta_{mi})$ between the microphone arrays $m_i$, as shown in Equation (16).

$$p([d'] \mid [d]) = \prod_i f(d'_{m_i}, d_{m_i}; \beta_{m_i}) \tag{16}$$

Here, the localized sound source direction [d'] and the estimated sound source direction [d] are vectors including the localized sound source direction $d'_{mi}$ and the estimated sound source direction $d_{mi}$ as an element, respectively. The probabilistic model assumes that the second probability $p(s_{j,k}|_{cj,k})$ of the estimated sound source position corresponding to the cluster $c_{j,k}$ into which the intersection $s_{j,k}$ is classified being obtained when the intersection $s_{j,k}$ between the microphone arrays $m_j$ and $m_k$ and the estimated sound source directions $d_{mj}$ and $d_{mk}$ is obtained follows a multivariate Gaussian distribution $N(s_{j,k}; \mu_{cj,k}, \Sigma_{cj,k})$ shown in Equation (17). $\mu_{cj,k}$ and $\Sigma_{cj,k}$ indicate a mean and a variance of the multivariate Gaussian distribution, respectively. This mean indicates the estimated sound source position, or a magnitude or a bias of a distribution of the estimated sound source positions. As described above, the intersection $s_{j,k}$ is a function that is determined from the positions $u_j$ and $u_k$ of the microphone arrays $m_j$ and $m_k$ and the estimated sound source directions $d_{mj}$ and $d_{mk}$. In the following description, a position of the intersection may be indicated as $g(d_{mj}, d_{mk})$. In the probabilistic model, the mean $\mu_{cj,k}$ and the variance $\Sigma_{cj,k}$ are some of the model parameters.

$$p(s_{j,k}|c_{j,k}) = N(s_{j,k}; \mu_{c_{j,k}}, \Sigma_{c_{j,k}}) \tag{17}$$

When the distribution of the intersections between the two microphone arrays and the estimated sound source direction [d] is obtained in the entire acoustic processing system S1, the probability p([d]|[c]) of the cluster [c] corresponding to each candidate sound source being obtained is assumed to approximate to a total power of the second probability $p(s_{j,k}|c_{j,k})$ between intersections as shown in Equation (18). [C] is a vector including the cluster $c_{j,k}$ as an element.

$$p([d] \mid [c]) = \prod_{d_j, d_k, m_j \neq m_k} p(d_{m_j}, d_{m_k} \mid c_{j,k}) = \prod_{d_j, d_k, m_j \neq m_k} p(g(d_{m_j}, d_{m_k}) \mid c_{j,k}) = \prod_{j,k, m_j \neq m_k} p(s_{j,k} \mid c_{j,k}) \tag{18}$$

Further, in the probabilistic model, an appearance probability $p(c_{j,k})$ of the cluster $c_{j,k}$ into which the intersection $s_{j,k}$ between the two microphone arrays $m_j$ and $m_k$ and the estimated sound source directions $d_{mj}$ and $d_{mk}$ is classified as the third probability is one model parameter. This parameter may be expressed as $\pi_{cj,k}$.

(Updating of Sound Source Position)

Next, a process of updating the sound source position using the above-described probabilistic model will be described. When the localized sound source direction [d'] is obtained through the sound source localization, the sound source position updating unit 142 recursively updates the estimated sound source position [d] so that the estimation probability p([c], [d], [d']) of the estimated sound source position [d] for each sound source candidate being classified into the cluster [c] corresponding to each sound source candidate becomes high. The sound source position updating unit 142 performs clustering on the distribution of intersections between the two microphone arrays and the estimated sound source direction to classify the distribution into a cluster [c].

In order to update the estimated sound source position [d], the sound source position updating unit 142 uses a scheme of applying a Viterbi training.

The sound source position updating unit 142 sequentially repeats a process of setting the model parameters [μ*], [Σ*], and [β*] to a fixed value and calculating an estimated sound source position [d*] and a cluster [c*] that maximize the estimation probability p([c], [d], [d']; [μ*], [Σ]*, [β*]) as shown in Equation (19) and a process of setting the calculated estimated sound source position [d*] and the calculated cluster [c*] to a fixed value and calculating the model parameters [π*], [μ*], [Σ*], and [β*] that maximize estimation probability p([c*], [d*], [d']; [μ], [Σ], [β]) as shown in Equation (20). . . . * indicates a maximized parameter . . . . Here, the maximization means macroscopically increasing or a process for that purpose, and temporarily or locally decreasing may be realized through the process.

$$[c^*], [d^*] \leftarrow \underset{[c],[d]}{\operatorname{argmax}} p([c], [d], [d']; [\mu^*], [\Sigma^*], [\beta^*]) \tag{19}$$

$$[\pi^*], [\mu^*], [\Sigma^*], [\beta^*] \leftarrow \underset{[\mu],[\Sigma],[\beta]}{\operatorname{argmax}} p([c^*], [d^*], [d']; [\mu], [\Sigma], [\beta]) \tag{20}$$

The right side of Equation (19) is transformed as shown in Equation (21) by applying Equations (16) to (18).

$$\begin{aligned} [c^*], [d^*] &\leftarrow \underset{[c],[d]}{\operatorname{argmax}} p([c], [d], [d']; [\mu^*], [\Sigma^*], [\beta^*]) \\ &= \underset{[c],[d]}{\operatorname{argmax}} p([d'] \mid [d]) p([d] \mid [c]) p([c]) \\ &= \underset{[c],[d]}{\operatorname{argmax}} \prod_i f(d'_{m_i}, d_{m_i}; \beta_i^*) \\ &\quad \prod_{d_j, d_k, m_j \neq m_k} p(d_{m_j}, d_{m_k} \mid c_{j,k}) p(c_{j,k}) \\ &= \underset{[c],[d]}{\operatorname{argmax}} \prod_i f(d'_{m_i}, d_{m_i}; \beta_i^*) \cdot \\ &\quad \prod_{d_j, d_k, m_j \neq m_k} N([g(d_{m_j}, d_{m_k})]; [\mu^*_{c_{j,k}}], [\Sigma^*_{c_{j,k}}]) p(c_{j,k}). \end{aligned} \tag{21}$$

As shown in Equation (21), the estimation probability p([c], [d], [d']) is expressed by a product in which the first probability, the second probability, and the third probability described above are factors. However, a factor of which the value is equal to or smaller than zero in Equation (21) is not a multiplication target. A right side of Equation (21) is decomposed into a function of the cluster $C_{j,k}$ and a function of the sound source direction [d] as shown in Equations (22) and (23). Therefore, the cluster $C_{j,k}$ and estimated sound source direction [d] can be updated individually.

$$c^*_{j,k} \leftarrow N([g(d^*_{m_j}, d^*_{m_k})];[\mu^*_{c_{j,k}}], [\Sigma^*_{c_{j,k}}])p(c_{j,k}) \sim \underset{c_{j,k}}{\operatorname{argmax}}\left(-([g(d^*_{m_j}, d^*_{m_k})] - [\mu^*_{c_{j,k}}])^T[\Sigma^*_{c_{j,k}}]^{-1} \cdot ([g(d^*_{m_j}, d^*_{m_k})] - [\mu^*_{c_{j,k}}])p(c_{j,k})\right) \tag{22}$$

$$[d^*] \leftarrow \underset{[d]}{\operatorname{argmax}} \prod_i f(d'_{m_i}, d_{m_i}; \beta_{m_i}) \cdot \prod_{d_j, d_k, m_j \neq m_k} N([g(d_{m_j}, d_{m_k})];[\mu^*_{c_{j,k}}], [\Sigma^*_{c_{j,k}}])p(c_{j,k}) \tag{23}$$

The sound source position updating unit 142 classifies all the intersections $g(d^*_{mj}, d^*_{mk})$ into a cluster [c*] having a cluster $c^*_{j,k}$ as an element such that a value of a right side of Equation (22) is increased.

The sound source position updating unit 142 performs hierarchical clustering when determining the cluster $c^*_{j,k}$.

The hierarchical clustering is a scheme of sequentially repeating a process of calculating a distance between the two clusters and merging the two clusters having the smallest distances to generate a new cluster. In this case, the sound source position updating unit 142 uses the smallest distance among the distances between the intersection $g(d^*_{mj}, d^*_{mk})$ classified into one cluster and a mean $\mu_{cj',k'}$ at a center of the other cluster $c_{j',k'}$, as the distance between the two clusters.

In general, since the estimated sound source direction [d] greatly depends on other variables, it is difficult to analytically calculate an optimal value. Therefore, the right side of Equation (23) is approximately decomposed into a function of the estimated sound source direction $d_{mi}$ as shown in Equation (24). The sound source position updating unit 142 updates the individual estimated sound source directions $d_{mi}$ so such that values shown in the third to fifth rows on the right side of Equation (24) are increased as a cost function.

$$d^*_{m_i} \leftarrow \underset{d_{m_i}}{\operatorname{argmax}} f(d'_{m_i}, d_{m_j}; \beta^*_{m_i}) \cdot \prod_{d_{m_i}, d_{m_j}, m_i \neq m_j} N([g(d_{m_i}, d_{m_j})];[\mu^*_{c_{i,j}}], [\Sigma^*_{c_{i,j}}])p(c_{i,j}) \sim \underset{d_{m_i}}{\operatorname{argmax}} \left\{\beta^*_{m_i}(d'_{m_i} \cdot d_{m_j}) \cdot - \prod_{d_{m_i}, d_{m_j}, m_i \neq m_j} ([g(d_{m_i}, d_{m_j})] - [\mu^*_{c_{i,j}}])^T[\Sigma^*_{c_{i,j}}]^{-1} ([g(d_{m_i}, d_{m_j})] - [\mu^*_{c_{i,j}}]) + \log p(c_{i,j})\right\} \tag{24}$$

When the sound source position updating unit 142 updates the estimated sound source direction $d_{mi}$, the sound source position updating unit 142 searches for the estimated sound source direction $d^*_{mi}$ using a gradient descent method under the constraint conditions (c1) and (c2) to be described next.

(c1) Each localized sound source direction [d'] estimated through the sound source localization approximates each corresponding true sound source direction [d].

(c2) A mean $\mu_{cj,k}$ corresponding to the estimated sound source position is in an area of a triangle having, as vertexes, three intersections $P_j$, $P_k$, and $P_i$ based on the estimated sound source directions $d^*_{mj}$, $d^*_{mk}$, and $d^*_{mi}$ updated immediately before. However, the microphone array $m_i$ is a microphone array that is separate from the microphone array $m_j$ and $m_k$.

Figure 7:
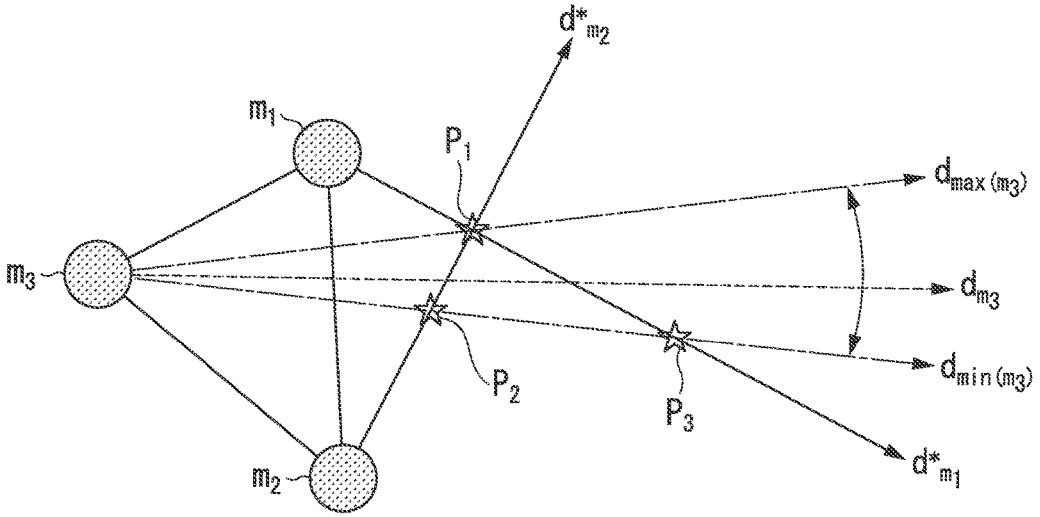
FIG. 7 is an illustrative diagram of a sound source direction search according to the embodiment.

For example, when the sound source position updating unit 142 updates the estimated sound source direction $d_{m3}$, the sound source position updating unit 142 determines the estimated sound source direction $d_{m3}$ in which the cost function described above is maximized, to be the estimated sound source direction $d^*_{m3}$ in a range of direction in which a direction of the intersection $P_2$ from the microphone array $m_3$ is a starting point $d_{min(m3)}$ and a direction of the intersection $P_1$ from the microphone array $m_3$ is an ending point $d_{max(m3)}$, as illustrated in FIG. 7.

When the sound source position updating unit 142 updates, for example, the other sound source directions $d_{m1}$ and $d_{m2}$, the sound source position updating unit 142 applies the same constraint condition and searches for the estimated sound source directions $d_{m1}$ and $d_{m2}$ in which the cost function is maximized. That is, the sound source position updating unit 142 searches for the estimated sound source direction $d^*_{m1}$ in which the cost function is maximized in a range of direction in which the direction of the intersection $P_3$ from the microphone array $m_1$ is a starting point $d_{min(m1)}$ and a direction of the intersection $P_2$ is an ending point $d_{max(m1)}$. The sound source position updating unit 142 searches for the estimated sound source direction $d^*_{m2}$ in which the cost function is maximized in a range of direction in which the direction of the intersection $P_1$ from the microphone array $m_2$ is a starting point $d_{min(m2)}$ and a direction of the intersection $P_3$ is an ending point $d_{max(m2)}$. Therefore, since a search region in the estimated sound source direction is limited to within a search region determined on the basis of the estimated sound source direction $d^*_{m1}$ updated immediately before or the like, the amount of calculation can be reduced. Further, the instability of a solution due to nonlinearity of the cost function is avoided.

It should be noted that a right side of Equation (20) is transformed as shown in Equation (25) by applying Equations (16) to (18). The sound source position updating unit 142 updates a model parameter set [π*], [μ*], [Σ*], and [β*] to increase the value of the right side of Equation (25).

$$[\pi^*], [\mu^*], [\Sigma^*], [\beta^*] \leftarrow \underset{[\mu],[\Sigma],[\beta]}{\operatorname{argmax}} \prod_i f(d'_{m_i}, d^*_{m_i}; \beta_{m_i}) \cdot \prod_{d^*_{m_j}, d^*_{m_k}, m_j \neq m_k} N([g(d^*_{m_j}, d^*_{m_k})];[\mu^*_{c^*_{j,k}}], [\Sigma^*_{c^*_{j,k}}])p(c^*_{j,k}) \tag{25}$$

In order to further increase the value of the right side of Equation (25), the sound source position updating unit 142 can calculate the model parameters $\pi^*_c$, $\mu^*_c$, and $\Sigma^*_c$ of each cluster c and the model parameter $\beta^*_m$ of each microphone array m on the basis of the localized sound source direction [d'], the updated estimated sound source direction [d*], and the updated cluster [c*] using a relationship shown in Equation (26).

$$\pi_c^* \leftarrow N_c/N \tag{26}$$

$$\mu_c^* \leftarrow \sum_{c_{j,k}=c} g(d_{m_j}^*, d_{m_k}^*)/N_c$$

$$\Sigma_c^* \leftarrow \sum_{c_{j,k}=c} (g(d_{m_j}^*, d_{m_k}^*) - \mu_c)^2/N_c$$

$$\beta_m^* \leftarrow \sum_{m_i=m} d'_{m_i} \cdot d_{m_i}^*/N_m,$$

$$\text{where } N_m = \sum_{m_i=m} 1$$

In Equation (26), the model parameter $\pi^*c$ indicates a ratio of the number of sound source candidates $N_c$ of which the estimated sound source positions belong to the cluster c, to the number of sound source candidates N, that is, an appearance probability in the cluster c into which the estimated sound source is classified. The model parameter $\mu^*_c$ indicates a mean value of the coordinates of the intersection $s_{j,k}$ (=$g(d^*_{mj}, d^*_{mk})$) belonging to the cluster c, that is, a center of the cluster c. The model parameter $\mu^*_c$ indicates a variance of the coordinates of the intersection $s_{j,k}$ belonging to the cluster c. The model parameter $\beta^*_m$ indicates a mean value of an inner product of the localized sound source direction $d'_{mi}$ and the estimated sound source direction $d^*_{mi}$ for the microphone array i.

Next, an example of the sound source position updating process according to the present embodiment will be described.

Figure 8:
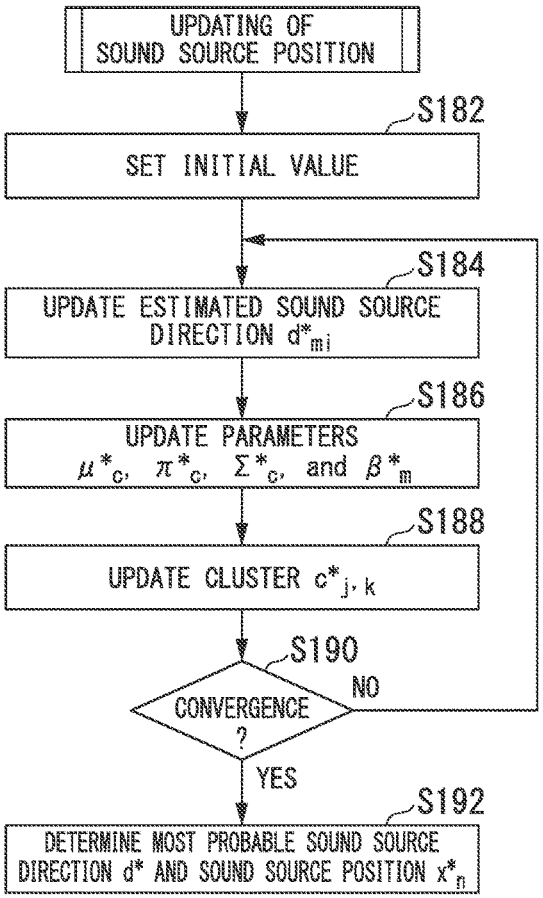
FIG. 8 is a flowchart showing an example of a sound source position updating process according to the embodiment.

FIG. 8 is a flowchart showing an example of the sound source position updating process according to the present embodiment.

(Step S182) The sound source position updating unit 142 sets various initial values related to the updating process. The sound source position updating unit 142 sets an initial value of the estimated sound source position for each sound source candidate indicated by the initial estimated sound source position information input from the initial value setting unit 140. Further, the sound source position updating unit 142 sets an initial value [d] of the estimated sound source position, an initial value [c] of the cluster, an initial value $\pi^*_c$ of the appearance probability, an initial value $\mu^*_c$ of the mean, an initial value $\Sigma^*_c$ of the variance, and an initial value $\beta^*_m$ of the shape parameter, as shown in Equation (27). The localized sound source direction [d'] is set as an initial value [d] of the estimated sound source direction. A cluster $c_n$ to which the initial value $x_n$ of the sound source estimation position belongs is set as an initial value $C_{j,k}$ of the cluster. A reciprocal of the cluster number C is set as an initial value $\pi^*C$ of the appearance probability. A mean value of the initial value $x_n$ of the sound source estimation position belonging to the cluster c is set as an initial value $\mu^*_c$ of the mean. A unit matrix is set as the initial value $\Sigma^*_c$ of variance. 1 is set as the initial value $\beta^*_m$ of the shape parameter. Thereafter, the process proceeds to step S184.

$$[d] \leftarrow [d'] \tag{27}$$

$$c_{j,k} \leftarrow c_n$$

$$\pi_c^* \leftarrow 1/C$$

-continued $$\mu_c^* \leftarrow \sum_{c_n=c} x_n/N_c$$

$$\Sigma_c^* \leftarrow \begin{pmatrix} 1 & 0 \\ 0 & 1 \end{pmatrix}$$

$$\beta_m^* \leftarrow 1$$

(Step S184) The sound source position updating unit 142 updates the estimated sound source direction $d^*_{mi}$ so that the cost function shown on the right side of Equation (24) increases under the above-described constraint condition. Thereafter, the process proceeds to step S186.

(Step S186) The sound source position updating unit 142 calculates an appearance probability $\pi^*_c$, a mean $\mu^*_c$, and a variance $\Sigma^*_c$ of each cluster c and a shape parameter $\beta^*_m$ of each microphone array m using the relationship shown in Equation (26). Thereafter, the process proceeds to step S188.

(Step S188) The sound source position updating unit 142 determines an intersection $g(d^*_{mj}, d^*_{mk})$ from the updated estimated sound source directions $d^*_{mj}$ and $d^*_{mk}$. The sound source position updating unit 142 performs clustering on the distribution of the intersection $(d^*_{mj}, d^*_{mk})$ to classify the distribution into a plurality of clusters $c_{j,k}$ so that the value of the cost function shown on the right side of Equation (22) is increased. Thereafter, the process proceeds to step S190.

(Step S190) The sound source position updating unit 142 calculates the amount of updating of either or both of the sound source direction $d^*_{mi}$ and the mean $\mu_{cj,k}$ that is the estimated sound source position $x^*_n$, and determines whether or not convergence has occurred according to whether or not the calculated amount of updating is smaller than a predetermined amount of updating. The amount of updating may be, for example, one of a square sum between the microphone arrays $m_i$ of a difference between sound source directions $d^*_{mi}$ before and after updating and a square sum between the clusters c of a difference before and after updating of the mean $\mu_{cj,k}$, or one of weighted sums thereof. When it is determined that the convergence has occurred (YES in step S190), the process proceeds to step S192. When it is determined that the convergence has not occurred (NO in step S190), the process returns to step S184.

(Step S192) The sound source position updating unit 142 determines the updated estimated sound source position $x^*_n$ as the most probable sound source position. The sound source position updating unit 142 outputs the estimated sound source position information indicating the estimated sound source position for each sound source candidate to the sound source specifying unit 16. The sound source position updating unit 142 may determine the updated estimated sound source direction [d*] to be the most probable sound source direction and output the estimated sound source position information indicating the estimated sound source direction for each sound source candidate to the sound source specifying unit 16. Further, the sound source position updating unit 142 may further include the sound source identification information for each sound source candidate in the estimated sound source position information and output the estimated sound source position information. The sound source identification information may include at least any one of indexes indicating three microphone arrays related to the initial value of the estimated sound source position of each sound source candidate and at least one of indexes indicating the sound source estimated through the sound source localization for each microphone array. Thereafter, the process illustrated in FIG. 8 ends.

(Process of Sound Source Specifying Unit)

Next, a process of the sound source specifying unit 16 according to the present embodiment will be described. The sound source position updating unit 142 determines the estimated sound source position on the basis of the three intersections of the sound source directions acquired by the two microphone arrays among the three microphone arrays. However, the direction of the sound source can be estimated independently from the acoustic signal acquired from each microphone array.

Figure 9:
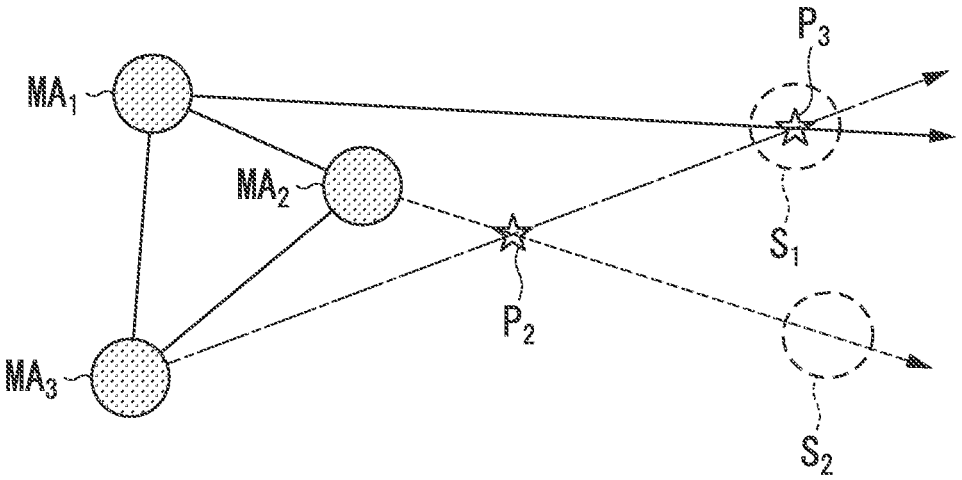
FIG. 9 is a diagram illustrating a detection example of a virtual image.

Therefore, the sound source position updating unit 142 may determine an intersection between sound source directions of different sound sources with respect to the two microphone arrays. Since the intersection occurs at a position different from the position in which the sound source actually exists, the intersection may be detected as a so-called ghost (virtual image). For example, in the example illustrated in FIG. 9, the sound source directions are estimated in the directions of the sound sources $S_1$, $S_2$, and $S_1$ by the microphone arrays $MA_1$, $MA_2$, and $MA_3$, respectively. In this case, since the intersection $P_3$ by the microphone arrays $MA_1$ and $MA_3$ is determined on the basis of the direction of the sound source $S_1$, the intersection $P_3$ approximates the position of the sound source $S_1$. However, since the intersection $P_2$ by the microphone arrays $MA_2$ and $MA_3$ is determined on the basis of the directions of the sound sources $S_2$ and $S_1$, the intersection $P_2$ is at a position away from the position of any of the sound sources $S_1$ and $S_2$.

Therefore, the sound source specifying unit 16 classifies the spectrum of the sound source-specific signal of each sound source for each microphone array into a plurality of second clusters, and determines whether or not the sound sources related to respective spectra belonging to the second clusters are the same. The sound source specifying unit 16 selects the estimated sound source position of the sound source determined to be the same in preference to the sound source determined not to be the same. Accordingly, the sound source position is prevented from being erroneously estimated through the detection of the virtual image.

(Frequency Analysis)

Figure 10:
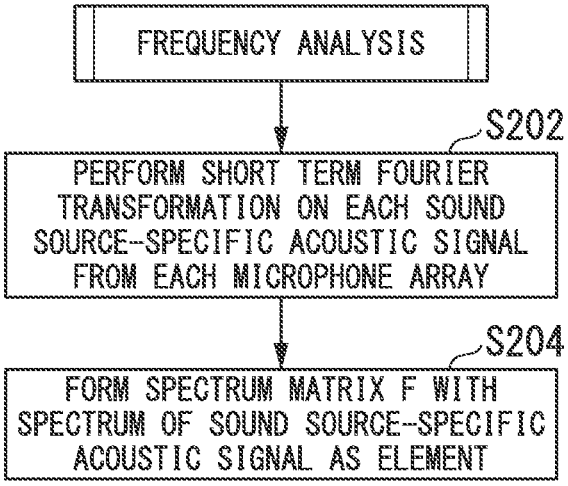
FIG. 10 is a flowchart showing an example of a frequency analysis process according to the embodiment.

The frequency analysis unit 124 performs frequency analysis on the sound source-specific acoustic signal separated for each sound source. FIG. 10 is a flowchart showing an example of a frequency analysis process according to the present embodiment.

(Step S202) The frequency analysis unit 124 performs short term Fourier transformation on a sound source-specific acoustic signal of each sound source separated from the acoustic signal acquired by each microphone array m, for each frame, to calculate spectra $[F_{m,1}]$ and $[F_{m,2}]$ to $[F_{m,sm}]$. Thereafter, the process proceeds to step S204.

(Step S204) The frequency analysis unit 124 integrates the frequency spectra calculated for the respective sound sources in a row for each microphone array m to form a spectrum matrix $[F_m]$. The frequency analysis unit 124 integrates the spectral matrix $[F_m]$ for each microphone array m between rows to form a spectrum matrix [F]. The frequency analysis unit 124 outputs the formed spectrum matrix [F] and the sound source direction information to the sound source specifying unit 16 in association with each other. Thereafter, the process illustrated in FIG. 10 ends.

(Score Calculation)

Figure 11:
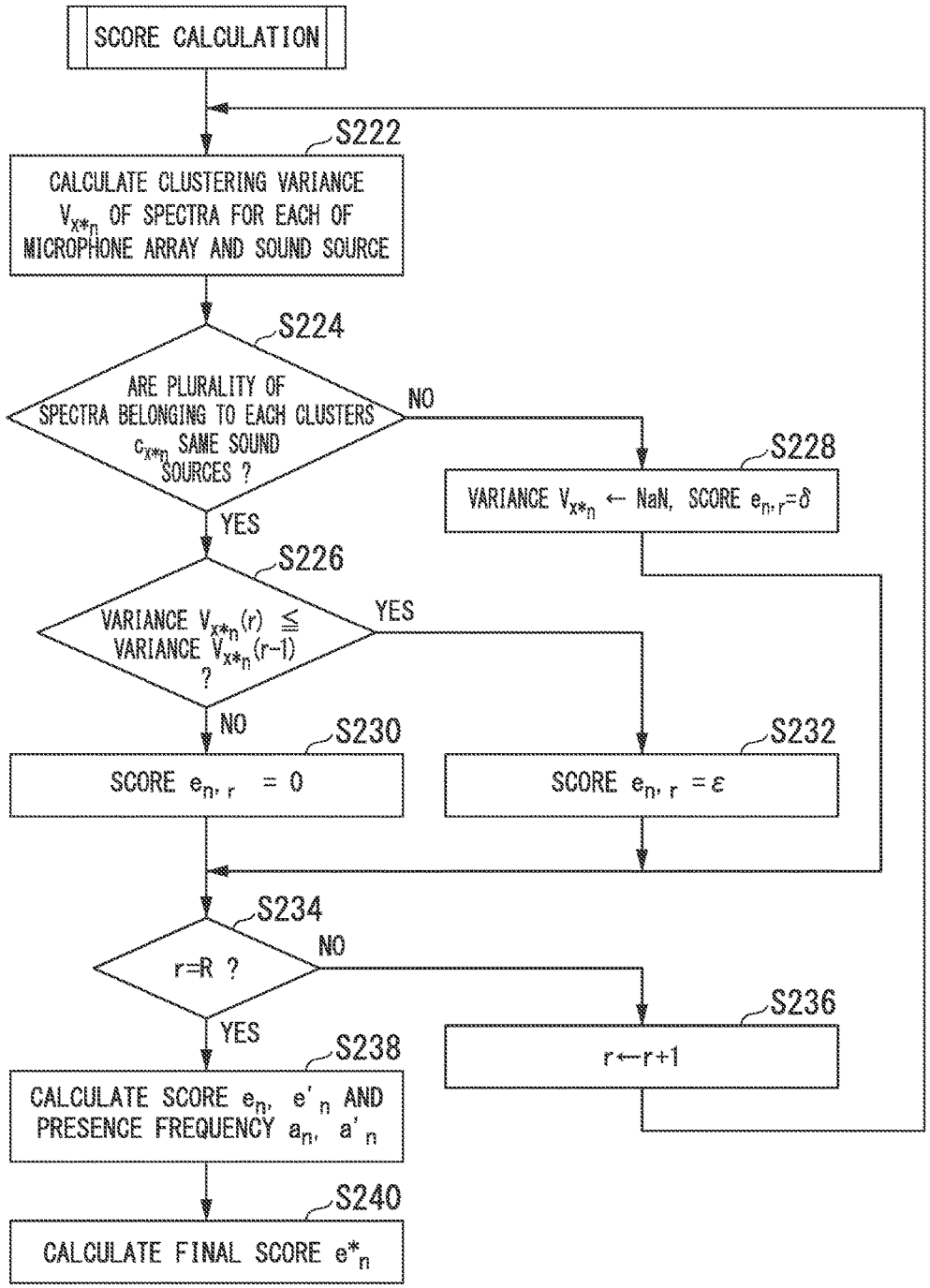
FIG. 11 is a flowchart showing an example of a score calculation process according to the embodiment.

The variance calculation unit 160 and the score calculation unit 162 of the sound source specifying unit 16 perform a score calculation process to be illustrated next. FIG. 11 is a flowchart showing an example of a score calculation process according to the present embodiment.

(Step S222) The variance calculation unit 160 performs clustering on the spectrum of each of the microphone array m and the set of sound source indicated by the spectrum matrix [F] input from the frequency analysis unit 124 using the k-means method to classify the spectrum into a plurality of second clusters. The number of clusters K is set in the variance calculation unit 160 in advance. However, the variance calculation unit 160 changes the initial value of the cluster for each spectrum for each repetition number r. The number of clusters K may be equal to the number N of sound source candidates. The variance calculation unit 160 forms a cluster matrix [c*] including an index $c_{i,x^*_n}$ of the second cluster classified for each spectrum as an element. Each column and each row of the cluster matrix [c*] are associated with the microphone array i and the sound source $x^*_n$, respectively. When the number M of microphone arrays is 3, the cluster matrix [c*] becomes a matrix of N rows and 3 columns, as shown in Equation (28).

$$[c^*] = \begin{bmatrix} c_{1,x_1^*} & c_{2,x_1^*} & c_{3,x_1^*} \\ c_{1,x_2^*} & c_{2,x_2^*} & c_{3,x_2^*} \\ \vdots & \vdots & \vdots \\ c_{1,x_N^*} & c_{2,x_N^*} & c_{3,x_N^*} \end{bmatrix}_{N\times 3} \tag{28}$$

The variance calculation unit 160 specifies the second cluster corresponding to each sound source candidate on the basis of the sound source identification information for each sound source candidate indicated by the estimated sound source position information input from the sound source position updating unit 142.

The variance calculation unit 160, for example, can specify the second cluster indicated by the index, which is arranged in a column of the microphone arrays and a row of sound sources included in the cluster matrix among columns of the microphone arrays and the columns of the sound sources indicated by the sound source identification information in the cluster matrix. The variance calculation unit 160 calculates a variance $V_{x^*_n}$ of the estimated sound source position for each sound source candidate corresponding to the second cluster. Thereafter, the process proceeds to step S224.

(Step S224) The variance calculation unit 160 determines whether or not the sound sources related to the plurality of classified spectra are the same sound sources for each of the second clusters $c_{x^*_n}$. For example, when the index value indicating the degree of similarity between two spectra among the plurality of spectra is higher than a predetermined degree of similarity, the variance calculation unit 160 determines that the sound sources are the same sound sources. When the index value indicating the degree of similarity between at least one set of spectra is equal to or smaller than the predetermined degree of similarity, the variance calculation unit 160 determines that the sound sources are not the same sound sources. As the index of the degree of similarity, for example, an inner product, a Euclidean distance, or the like can be used. The inner product indicates a higher degree of similarity when a value of the inner product is greater. The Euclidean distance indicates a lower degree of similarity when a value of the Euclidean distance is smaller. It should be noted that the variance calculation unit 160 may calculate a variance of a plurality of spectrums as an index of a degree of similarity of the plurality of spectrums. The variance calculation unit 160 may determine that the sound sources are the same sound sources when the variance is smaller than a predetermined threshold value of the variance and determine that the sound sources are not the same sound sources when the variance is equal to or greater than the predetermined threshold value of the variance. When it is determined that the sound sources are the same sound sources (YES in step S224), the process proceeds to step S226. When it is determined that the sound sources are not the same sound sources (NO in step S224), the process proceeds to step S228.

(Step S226) The variance calculation unit 160 determines whether or not the variance $V_{x*n}(r)$ calculated for the second cluster $c_{x*n}$ at the current repetition number r is equal to or smaller than the variance $V_{x*n}(r-1)$ calculated at a previous repetition number r−1. When it is determined that the variance $V_{x*n}(r)$ is equal to or smaller than the variance $V_{x*n}(r-1)$ (YES in step S226), the process proceeds to step S232. When it is determined that the variance $V_{x*n}(r)$ is greater than the variance $V_{x*n}(r-1)$ (NO in step S226), the process proceeds to step S230.

(Step S228) The variance calculation unit 160 sets the variance $V_{x*n}(r)$ of the second cluster $c_{x*n}$ of the current repetition number r to NaN and sets the scores $e_{n,r}$ to δ. NaN is a symbol (notanumber) indicating that variance is invalid. δ is a predetermined real number smaller than zero. Thereafter, the process proceeds to step S234.

(Step S230) The variance calculation unit 160 sets the score $e_{n,r}$ of the second cluster $c_{x*n}$ of the current repetition number r to 0. Thereafter, the process proceeds to step S234.

(Step S232) The variance calculation unit 160 sets the score $e_{n,r}$ of the second cluster $c_{x*n}$ of the current repetition number r to ε. Thereafter, the process proceeds to step S234.

(Step S234) The variance calculation unit 160 determines whether or not the current repetition number r has reached a predetermined repetition number R. When it is determined that the current repetition number r has not reached (NO in step S234), the process proceeds to step S236. When it is determined that the current repetition number r has reached (YES in step S234), the variance calculation unit 160 outputs the score calculation information indicating the score of each time for each second cluster and the estimated sound source position to the score calculation unit 162, and the process proceeds to step S238.

(Step S236) The variance calculation unit 160 increases the current repetition number r by 1. Thereafter, the process returns to step S222.

(Step S238) The score calculation unit 162 calculates a sum $e_n$ of the scores $e_{n,r}$ for each second cluster $c_{x*n}$ on the basis of the score calculation information input from the variance calculation unit 160 as shown in Equation (29). The score calculation unit 162 calculates a sum $e'_n$ of the sum values $e_i$ of the second clusters i corresponding to the estimated sound source positions $x_i$ of which the coordinate values $x_n$ are in a predetermined range. This is because the second cluster corresponding to the estimated sound source positions having the same coordinate values or being in a predetermined range is integrated as one second cluster. The generation of the second cluster corresponding to the estimated sound source positions having the same coordinate values or being within a predetermined range is because a sound generation period from one sound source is generally longer than a frame length for frequency analysis, and frequency characteristics vary.

$$e_n = \sum_r e_{n,r} \tag{29}$$

-continued $$e'_n = \sum_i e_i, \text{ where } x_i^* \sim x_n^*, i = 1, 2, \ldots, N$$

The score calculation unit 162 counts the number of times the effective variance has been calculated for each second cluster $c_{x*n}$ as a presence frequency an on the basis of the score calculation information input from the variance calculation unit 160 as shown in Equation (30). The score calculation unit 162 can determine whether or not the effective variance is not calculated on the basis of whether or not NaN has been set in the variance $V_{x*n}(r)$. $a_{n,r}$ on the right side of the first row of Equation (30) are 0 for the number of repetition r at which NaN has been set and 1 for the number of repetition r at which NaN has not been set.

The score calculation unit 162 calculates a sum $a'_n$ of the presence frequency $a_i$ of the second clusters i corresponding to the estimated sound source positions $x_i$ of which the same coordinate values $x_n$ are in a predetermined range. Thereafter, the process proceeds to step S240.

$$a_n = \sum_r a_{n,r} \tag{30}$$

$$a'_n = \sum_i a_i, \text{ where } x_i^* \sim x_n^*, i = 1, 2, \ldots, N$$

(Step S240) As shown in Equation (31), the score calculation unit 162 divides a sum $e'_n$ of the score by a total sum $a'_n$ of the presence frequency for each of the integrated second clusters n to calculate a final score $e^*_n$. The integrated second cluster n corresponds to an individual sound source candidate. The score calculation unit 162 outputs final score information indicating a final score for each of the calculated sound source candidates and the estimated sound source position to the sound source selection unit 164. Thereafter, the process illustrated in FIG. 11 ends.

$$e_n^* = e_n'/a_n' \tag{31}$$

In the above-described example, a case in which the scores $e_{n,r}$ are set to δ, 0, and ε in steps S228, S230, and S232, respectively has been described by way of example, but the present invention is not limited thereto. A magnitude relationship between the values of the scores $e_{n,r}$ determined in steps S228, S230, and S232 may be an ascending order.

(Sound Source Selection)

Figure 12:
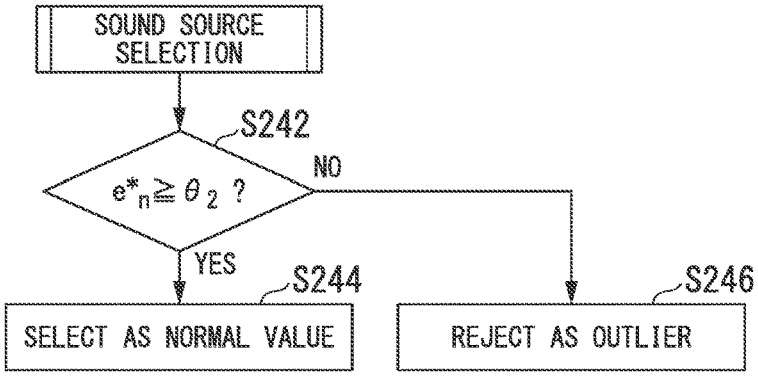
FIG. 12 is a flowchart showing an example of a sound source selection process according to the embodiment.

The sound source selection unit 164 performs a sound source selection process to be illustrated next. FIG. 12 is a flowchart showing an example of a sound source selection process according to this embodiment.

(Step S242) The sound source selection unit 164 determines whether or not the final score $e^*_n$ of the sound source candidate indicated by the final score information input from the score calculation unit 162 is equal to or greater than a predetermined final score threshold value $\theta_2$. When it is determined that the final score $e^*_n$ is equal to or greater than the threshold value $\theta_2$ (YES in step S242), the process proceeds to step S244. When it is determined that the final score $e^*_n$ is smaller than the threshold value $\theta_2$ (NO in step S242), the process proceeds to step S246.

(Step S244) The sound source selection unit 164 determines that the final score $e^*_n$ is a normal value (inlier), and selects the sound source candidate as a sound source. The sound source selection unit 164 outputs the output sound source position information indicating the estimated sound source position corresponding to the selected sound source to the outside of the acoustic processing device 1 via the output unit 18.

(Step S246) The sound source selection unit 164 determines that the final score $e^*_n$ is an abnormal value (Outlier), and rejects the corresponding sound source candidate without selecting the sound source candidate as a sound source. Thereafter, the process illustrated in FIG. 12 ends.

(Acoustic Processing)

Figure 13:
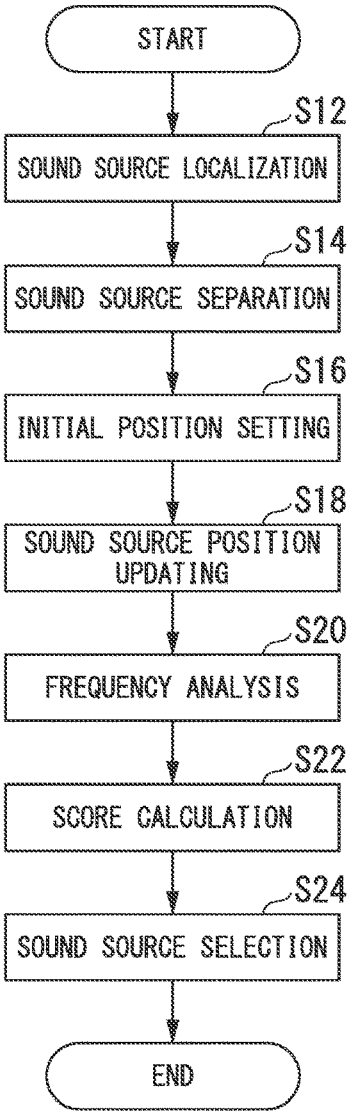
FIG. 13 is a flowchart showing an example of acoustic processing according to the embodiment.

The acoustic processing device 1 performs the following acoustic processing to be illustrated next as a whole. FIG. 13 is a flowchart showing an example of the acoustic processing according to the present embodiment.

(Step S12) The sound source localization unit 120 estimates the localized sound source direction of each sound source for each frame having a predetermined length on the basis of the acoustic signals of a plurality of channels input from the input unit 10 and acquired from the respective microphone arrays (Sound source localization). The sound source localization unit 120 uses, for example, a MUSIC method in the sound source localization. Thereafter, the process proceeds to step S14.

(Step S14) The sound source separation unit 122 separates the acoustic signals acquired from the respective microphone arrays into sound source-specific acoustic signals for the respective sound sources on the basis of the localized sound source directions for the respective sound sources. The sound source separation unit 122 uses, for example, a GHDSS method in the sound source separation unit. Thereafter, the process proceeds to step S16.

(Step S16) The initial value setting unit 140 determines the intersection on the basis of the localized sound source direction estimated for each set of two microphone arrays among the three microphone arrays using a triangulation. The initial value setting unit 140 determines the determined intersection as an initial value of the estimated sound source position of the sound source candidate. Thereafter, the process proceeds to step S18.

(Step S18) The sound source position updating unit 142 classifies the distribution of intersections determined on the basis of the estimated sound source direction for each set of two microphone arrays into a plurality of clusters. The sound source position updating unit 142 updates the estimated sound source position so that the probability of the estimated sound source position for each sound source candidate belonging to the cluster corresponding to each sound source candidate becomes high. Here, the sound source position updating unit 142 performs the sound source position updating process described above. Thereafter, the process proceeds to step S20.

(Step S20) The frequency analysis unit 124 performs frequency analysis on the sound source-specific acoustic signal separated for each sound source for each microphone array, and calculates the spectrum. Thereafter, the process proceeds to step S22.

(Step S22) The variance calculation unit 160 classifies the calculated spectrum into a plurality of second clusters and determines whether or not the sound sources related to the spectrum belonging to the classified second cluster are the same as each other. The variance calculation unit 160 calculates the variance of the estimated sound source positions for each sound source candidate related to the spectrum belonging to the second cluster. The score calculation unit 162 determines a final score for each second cluster so that the second cluster related to the sound source determined to be the same is larger than the second cluster related to the sound source determined not to be the same. The score calculation unit 162 determines the final score so that the cluster in which the variance of the estimated sound source positions is less in each repetition becomes larger, as stability of the second cluster. Here, the variance calculation unit 160 and the score calculation unit 162 perform the above-described score calculation process. Thereafter, the process proceeds to step S24.

(Step S24) The sound source selection unit 164 selects the sound source candidate corresponding to the second cluster of which the final score is equal to or greater than a predetermined threshold value of the final score, as the sound source, and rejects the sound source candidate corresponds to the second cluster of which the final score is smaller than the predetermined threshold value of the final score. The sound source selection unit 164 outputs the estimated sound source position related to the selected sound source. Thereafter, the process illustrated in FIG. 13 ends.

(Frame Data Analysis)

The acoustic processing system S1 includes a storage unit (not illustrated) and may store the acoustic signal picked up by each microphone array before the acoustic processing illustrated in FIG. 13 is performed. The storage unit may be configured as a part of the acoustic processing device 1 or may be installed in an external device separate from the acoustic processing device 1. The acoustic processing device 1 may perform the acoustic processing illustrated in FIG. 13 using the acoustic signal read from the storage unit (batch processing).

The sound source position updating process (step S18) and the score calculation process (step S22) among the acoustic processing of FIG. 13 described above require various types of data based on acoustic signals of a plurality of frames and have a long processing time. In on-line processing, when processing of the next frame is started after the process of FIG. 13 has been completed for a certain frame, the output becomes intermittent, which is not realistic.

Therefore, in the on-line processing, the processes of steps S12, S14, and S20 in the initial processing unit 12 may be performed in parallel with the processes of steps S16, S18, S22, and S24 in the sound source position estimation unit 14 and the sound source specifying unit 16. However, in the processes of steps S12 to S14 and S20, the acoustic signal in the first section up to a current time t0 and various types of data derived from the acoustic signal are processing targets. In the processes of steps S12, S14, and S20, the acoustic signal within the first section up to the current time t0 or various types of data derived from the acoustic signal are processing targets. In the processes of steps S16, S18, S22, and S24, the acoustic signal or various types of data within the second section before the first section are processing targets.

Figure 14:
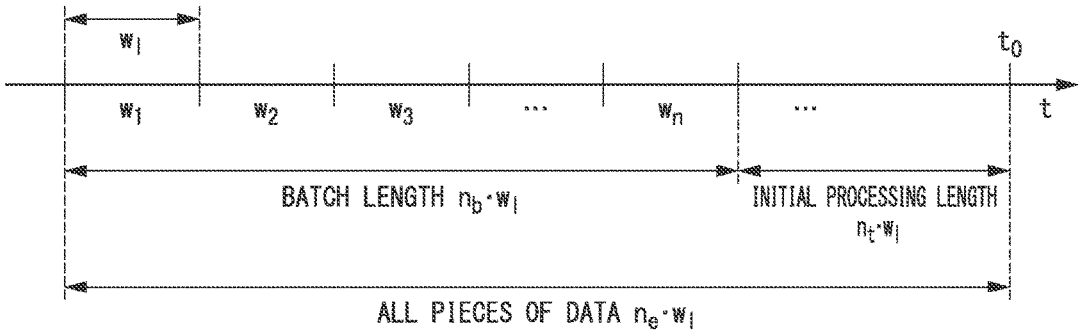
FIG. 14 is a diagram illustrating an example of a data section of a processing target.

FIG. 14 is a diagram illustrating an example of a data section of a processing target. In FIG. 14, a lateral direction indicates time. $t_0$ on upper right indicates a current time. $w_1$ indicates a frame length of individual frames $w_1$, $w_2$, . . . . The most recent acoustic signal for each frame is input to the input unit 10 of the acoustic processing device 1, and a storage unit (not illustrated) of the acoustic processing device 1 stores data that is derived from the acoustic signal having a period of $n_e \cdot w_1$. The storage unit rejects the most past acoustic signal and data for each frame. $n_e$ indicates the number of frames of all pieces of data to be stored. The initial processing unit 12 performs the processes of steps S12 to S14 and S20 using the data within a latest first section among all of pieces of the data. A length of the first section corresponds to an initial processing length $n_t \cdot w_1$. $n_t$ indicates the number of frames with a predetermined initial processing length. The sound source position estimation unit 14 and the sound source specifying unit 16 perform the processes of steps S16, S18, S22, and S24 using data in a second section after an end of the first section among all of pieces of the data. A length of the second section corresponds to a batch length $n_b \cdot w_1$. $n_b$ indicates the number of frames with a predetermined batch length. In the first section and the second section, an acoustic signal of the latest frame, an acoustic signal of a (n+1)-th frame, and data to be derived are added for each frame. On the other hand, in the first section and the second section, an acoustic signal of an $n_t$ frame and data to be derived from the acoustic signal, and an acoustic signal of an $n_e$-th frame and data to be derived are rejected for each frame. Thus, in the initial processing unit 12, the sound source position estimation unit 14, and the sound source specifying unit 16, the acoustic processing illustrated in FIG. 13 can be executed on-line so that the output continues between the frames by selectively using the data in the first section and the data in the second section.

As described above, the acoustic processing device 1 according to the present embodiment includes the sound source localization unit 120 that determines the localized sound source direction which is a direction of the sound source on the basis of the acoustic signals of a plurality of channels acquired from the M sound pickup units 20 being at different positions. Further, the acoustic processing device 1 includes the sound source position estimation unit 14 that determines the intersection of the straight line to the estimated sound source direction, which is a direction from the sound pickup unit 20 to the estimated sound source position of the sound source for each set of the two sound pickup units 20.

The sound source position estimation unit 14 classifies the distribution of intersections into a plurality of clusters and updates the estimated sound source positions so that the estimation probability that is a probability of the estimated sound source positions being classified into clusters corresponding to the sound sources becomes high.

With this configuration, the estimated sound source position is adjusted so that the probability of the estimated sound source position of the corresponding sound source being classified in the range of clusters into which the intersections determined by the localized sound source directions from different sound pickup units 20 are classified becomes higher. Since the sound source is highly likely to be in the range of the clusters, the estimated sound source position to be adjusted can be obtained as a more accurate sound source position.

Further, the estimation probability is a product having a first probability that is a probability of the estimated sound source direction being obtained when the localized sound source direction is determined, a second probability that is a probability of the estimated sound source position being obtained when the intersection is determined, and a third probability that is an appearance probability of the cluster into which the intersection is classified, as factors.

Generally, although the localized sound source direction, the estimated sound source position, and the intersection depend on each other, the sound source position estimation unit 14 can determine the estimated sound source position using the first probability, the second probability, and the third probability as independent estimation probability factors. Therefore, a calculation load related to adjustment of the estimated sound source position is reduced.

Further, the first probability follows a von-Mises distribution with reference to the localized sound source direction, and the second probability follows a multidimensional Gaussian function with reference to the position of the intersection. The sound source position estimation unit 14 updates the shape parameter of the von-Mises distribution and the mean and variance of the multidimensional Gaussian function so that the estimation probability becomes high.

With this configuration, a function of the estimated sound source direction of the first probability and a function of the estimated sound source position of the second probability are represented by a small number of parameters such as the shape parameter, the mean, and the variance. Therefore, a calculation load related to the adjustment of the estimated sound source position is further reduced.

Further, the sound source position estimation unit 14 determines a centroid of three intersections determined from the three sound pickup units 20 as an initial value of the estimated sound source position.

With this configuration, it is possible to set the initial value of the estimated sound source position in a triangular region having three intersections at which the sound source is highly likely to be as vertexes. Therefore, a calculation load until a change in the estimated sound source position due to adjustment converges is reduced.

Further, the acoustic processing device 1 includes a sound source separation unit 122 that separates acoustic signals of a plurality of channels into sound source-specific signals for respective sound sources, and a frequency analysis unit 124 that calculates a spectrum of the sound source-specific signal. The acoustic processing device 1 includes a sound source specifying unit 16 that classifies the calculated spectra into a plurality of second clusters, determines whether or not the sound sources related to the respective spectra classified into the second clusters are the same, and selects the estimated sound source position of the sound source determined to be the same in preference to the sound source determined not to be the same.

With this configuration, a likelihood of the estimated sound source position estimated on the basis of the intersection of the localized sound source direction of the sound source not determined to be the same on the basis of the spectrum being rejected becomes higher. Therefore, it is possible to reduce a likelihood of the estimated sound source position being erroneously selected as a virtual image (ghost) on the basis of the intersection between estimated sound source directions of different sound sources.

The sound source specifying unit 16 evaluates stability of a second cluster on the basis of the variance of the estimated sound source positions of the sound sources related to the spectra classified into each of the second clusters, and preferentially selects the estimated sound source position of the sound source of which the spectrum is classified into the second cluster having higher stability.

With this configuration, a likelihood of the estimated sound source position of the sound source corresponding to the second cluster into which the spectrum of a normal sound source is classified being selected becomes higher. That is, a likelihood of the estimated sound source position estimated on the basis of the intersection between the estimated sound source directions of different sound sources being accidentally included in the second cluster in which the estimated sound source position is selected becomes lower. Therefore, it is possible to further reduce the likelihood of the estimated sound source position being erroneously selected as the virtual image on the basis of the intersection between the estimated sound source directions of different sound sources.

Although the embodiments of the present invention have been described above with reference to the drawings, specific configurations are not limited to those described above, and various design changes or the like can be performed without departing from the gist of the present invention.

For example, the variance calculation unit 160 performs the processes of steps S222 and S224 among the processes of FIG. 11 and may not perform the processes of steps S226 to S240. In this case, the score calculation unit 162 may be omitted. In this case, the sound source selection unit 164 may select the candidate sound source corresponding to the second clusters, in which the sound sources related to the spectrum classified into the second cluster are determined to be the same, as the sound source, and reject the candidate sound source corresponding to the second clusters not determined to be the same. The sound source selection unit 164 outputs the output sound source position information indicating the estimated sound source position corresponding to the selected sound source to the outside of the acoustic processing device 1.

Further, in the acoustic processing device 1, the frequency analysis unit 124 and the sound source specifying unit 16 may be omitted. In this case, the sound source position updating unit 142 outputs the estimated sound source position information indicating the estimated sound source position for each sound source candidate to the output unit 18.

The acoustic processing device 1 may be configured as a single device integrated with the sound pickup units 20-1 to 20-M.

The number M of sound pickup units 20 is not limited to three and may be four or more. Further, the numbers of channels of acoustic signals that can be picked up by the respective sound pickup unit 20 may be different, or the number of sound sources that can be estimated from the respective acoustic signals may be different.

The probability distribution followed by the first probability is not limited to the von-Mises distribution, but may be a one-dimensional probability distribution giving a maximum value for a certain reference value in a one-dimensional space, such as a derivative of a logistic function.

The probability distribution followed by the second probability is not limited to the multidimensional Gaussian function, but may be a multidimensional probability distribution giving a maximum value for a certain reference value in a multidimensional space, such as a first derivative of a multidimensional logistic function.

It should be noted that a portion of the acoustic processing device 1 according to the embodiments and the modification examples described above, for example, the sound source localization unit 120, the sound source separation unit 122, the frequency analysis unit 124, the initial value setting unit 140, the sound source position updating unit 142, the variance calculation unit 160, the score calculation unit 162, and the sound source selection unit 164 may be realized by a computer. In this case, a control function thereof can be realized by recording a program for realizing the control function on a computer-readable recording medium, loading the program recorded on the recording medium to a computer system, and executing the program. Further, the "computer system" stated herein is a computer system embedded into the acoustic processing device 1 and includes an OS or hardware such as a peripheral device. Further, the "computer-readable recording medium" refers to a portable medium such as a flexible disk, a magneto-optical disc, a ROM, or a CD-ROM, or a storage device such as a hard disk embedded in the computer system. Further, the "computer-readable recording medium" refers to a recording medium that dynamically holds a program for a short period of time, such as a communication line when the program is transmitted over a network such as the Internet or a communication line such as a telephone line or a recording medium that holds a program for a certain period of time, such as a volatile memory inside a computer system including a server and a client in such a case. Further, the program may be a program for realizing some of the above-described functions or may be a program capable of realizing the above-described functions in combination with a program previously stored in the computer system.

Further, in this embodiment, a portion or all of the acoustic processing device 1 according to the embodiments and the modification examples described above may be realized as an integrated circuit such as a large scale integration (LSI). Each functional block of the acoustic processing device 1 may be individually realized as a processor, or a portion or all thereof may be integrated and realized as a processor. Further, an integrated circuit realization scheme is not limited to the LSI and the function blocks may be realized as a dedicated circuit or a general-purpose processor. Further, in a case in which an integrated circuit realization technology with which the LSI is replaced appears with the advance of a semiconductor technology, an integrated circuit according to the technology may be used.

What is claimed is:

1. An acoustic processing device comprising:

a sound source localization unit configured to determine a localized sound source direction that is a direction to a sound source on the basis of acoustic signals of a plurality of channels acquired from M (M is an integer equal to or greater than 3) microphone arrays being at different positions; and a sound source position estimation unit configured to determine an intersection of straight lines to an estimated sound source direction, the estimated sound source direction being a direction from each microphone array to an estimated sound source position of the sound source for each set of two microphone arrays, classify a distribution of intersections into a plurality of clusters, and update the estimated sound source position for each set of the two microphone arrays so that an estimation probability that is a probability of the estimated sound source positions being classified into clusters corresponding to sound sources becomes high.

2. The acoustic processing device according to claim 1, wherein the estimation probability is a product having a first probability that is a probability of the estimated sound source direction being obtained when the localized sound source direction is determined, a second probability that is a probability of the estimated sound source position being obtained when the intersection is determined, and a third probability that is a probability of appearance of the cluster into which the intersection is classified, as factors.

3. The acoustic processing device according to claim 2, wherein the first probability follows a von-Mises distribution with reference to the localized sound source direction, the second probability follows a multidimensional Gaussian function with reference to a position of the intersection, and the sound source position estimation unit updates a shape parameter of the von-Mises distribution and a mean and variance of the multidimensional Gaussian function so that the estimation probability becomes high.

4. The acoustic processing device according to claim 1, wherein M equals 3 and the sound source position estimation unit determines a centroid of three intersections determined from three microphone arrays as an initial value of the estimated sound source position.

5. The acoustic processing device according to claim 1, further comprising:

a sound source separation unit configured to separate acoustic signals of the plurality of channels into sound source-specific signals for respective sound sources;

a frequency analysis unit configured to calculate a spectrum of each of the sound source-specific signals; and a sound source specifying unit configured to classify the spectra into a plurality of second clusters, determine whether or not the sound sources related to the respective spectra classified into the second clusters are the same, and select the estimated sound source position of a sound source determined to be the same in preference to a sound source determined not to be the same.

6. The acoustic processing device according to claim 5, wherein the sound source specifying unit evaluates stability of a second cluster on the basis of a variance of the estimated sound source positions of the sound sources related to the spectra classified into each of the second clusters; and preferentially selects the estimated sound source position of a sound source of which the spectrum is classified into a second cluster having higher stability.

7. An acoustic processing method in an acoustic processing device the acoustic processing method comprising:

a sound source localization step in which the acoustic processing device determines a localized sound source direction that is a direction to a sound source on the basis of acoustic signals of a plurality of channels acquired from M (M is an integer equal to or greater than 3) microphone arrays being at different positions; and a sound source position estimation step in which the acoustic processing device determines an intersection of straight lines to an estimated sound source direction, the estimated sound source direction being a direction from each microphone array to an estimated sound source position of the sound source for each set of two microphone arrays, classifies a distribution of intersections into a plurality of clusters, and updates the estimated sound source position for each set of two microphone arrays so that an estimation probability that is a probability of the estimated sound source positions being classified into clusters corresponding to sound sources becomes high.

8. A non-transitory storage medium having a program stored therein, the program causing a computer to execute:

a sound source localization procedure of determining a localized sound source direction that is a direction to a sound source on |the|$_{[SK1]}$ basis of acoustic signals of a plurality of channels acquired from M (M is an integer equal to or greater than 3) microphone arrays being at different positions; and a sound source position estimation procedure of determining an intersection of straight lines to an estimated sound source direction, the estimated sound source direction being a direction from each microphone array to an estimated sound source position of the sound source for each set of two microphone arrays, classifies a distribution of intersections into a plurality of clusters, and updates the estimated sound source position for each set of two microphone arrays so that an estimation probability that is a probability of the estimated sound source positions being classified into clusters corresponding to sound sources becomes high.

* * * * *